US011380155B2

(12) United States Patent
Yamamiya

(10) Patent No.: US 11,380,155 B2
(45) Date of Patent: Jul. 5, 2022

(54) MULTI-UNIT COIN EJECTION APPARATUS

(71) Applicant: ASAHI SEIKO CO., LTD., Tokyo (JP)

(72) Inventor: Takahito Yamamiya, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 212 days.

(21) Appl. No.: 16/794,743

(22) Filed: Feb. 19, 2020

(65) Prior Publication Data

US 2020/0265666 A1 Aug. 20, 2020

(30) Foreign Application Priority Data

Feb. 20, 2019 (JP) ..... JP2019-028923

(51) Int. Cl.
*G07D 1/02* (2006.01)

(52) U.S. Cl.
CPC ..... *G07D 1/02* (2013.01); *G07D 2201/00* (2013.01)

(58) Field of Classification Search
CPC ..... G07D 1/02; G07D 2201/00
See application file for complete search history.

(56) References Cited

U.S. PATENT DOCUMENTS 2,910,991 A * 11/1959 Quinn ..... G07D 1/00 453/21
4,834,689 A * 5/1989 Levasseur ..... G07D 1/02 453/21

(Continued)

FOREIGN PATENT DOCUMENTS

JP 2514825 B2 4/1996
JP 3424181 B2 7/2003

(Continued)

OTHER PUBLICATIONS

Extended European Search Report issued in European Patent Application No. 20157620.4, dated Jul. 8, 2020.

(Continued)

*Primary Examiner* — Thien M Le
*Assistant Examiner* — Asifa Habib
(74) *Attorney, Agent, or Firm* — Greenblum & Bernstein, P.L.C.

(57) ABSTRACT

A multi-unit coin ejection apparatus that drives selectively coin ejection units using a single motor is provided, which eliminates a selectively coin-emitting mechanism such as a shutter provided in each coin ejection unit. Coin ejection units are selectively driven by switching a destination of a driving force of a first motor using a switching unit. The switching unit has first coupling gears respectively provided for the coin ejection units, second coupling gears engageable with the corresponding first coupling gears, and a coupling gear displacement mechanism configured to displace the second coupling gears between a connection position and a non-connection position. The coupling gear displacement mechanism is operated in response to an instruction such that a designated one of the second coupling gears is disposed at the connection position and a remainder of the second coupling gears is/are disposed at the non-connection position in accordance with the instruction.

7 Claims, 21 Drawing Sheets

(56) References Cited

U.S. PATENT DOCUMENTS

| | | | | |
|---|---|---|---|---|
| 6,213,341 | B1 * | 4/2001 | Keith, III | G07D 1/00 221/6 |
| 9,202,325 | B2 * | 12/2015 | Umeda | G07F 9/06 |
| 2003/0148729 | A1 * | 8/2003 | Abe | G07D 1/02 453/57 |
| 2005/0124280 | A1 * | 6/2005 | Itako | G07D 1/00 453/18 |
| 2008/0082207 | A1 * | 4/2008 | Sjostrom | G07G 1/0018 700/231 |
| 2016/0321850 | A1 * | 11/2016 | Kodama | G07D 1/00 |
| 2021/0090370 | A1 * | 3/2021 | Blythin | G07D 1/02 |

FOREIGN PATENT DOCUMENTS

| | | | |
|---|---|---|---|
| JP | 6182787 | B2 | 8/2017 |
| WO | 2017/038366 | A1 | 3/2017 |

OTHER PUBLICATIONS

Taiwan Office Action issued in TW Patent Application No. 109104854, dated Jun. 29, 2021 and English translation thereof.

English language Machine Translation of previously submitted WO2017/038366 that published on Mar. 9, 2017.

Search Report of Patent Application No. 109104854, dated Jun. 12, 2021.

* cited by examiner (CAM END = DIAGONALLY DOWNWARD RIGHT)

(COUPLING GEAR = NON-CONNECTED)

(CAM END = DIAGONALLY UPWARD RIGHT)

(COUPLING GEAR = NON-CONNECTED)

(CAM END = DIAGONALLY UPWARD LEFT)

(COUPLING GEAR = NON-CONNECTED)

(CAM END = DIAGONALLY DOWNWARD LEFT)

(COUPLING GEAR = CONNECTED)

NON-CONNECTED STATE
(NON-CONNECTION POSITION)

CONNECTED STATE
(CONNECTION POSITION)

MULTI-UNIT COIN EJECTION APPARATUS

BACKGROUND OF THE INVENTION

1. Field of the Invention

The present invention relates to a multi-unit coin ejection apparatus having a plurality of coin ejection units and more particularly, to a multi-unit coin ejection apparatus capable of selectively activating or driving a plurality of coin ejection units using a single motor in response to instructions.

In this specification, the term "coin" has a wide meaning that includes not only coins as currency but also coin equivalents such as tokens and medals other than coins as currency, in which the shape of a "coin" is not limited to a circular one and may be a polygonal or any other one.

2. Description of the Related Art

Conventionally, multi-unit coin ejection apparatuses having a plurality of coin ejection units have been known. For example, Japanese Examined Patent Publication No. 6182787 issued on Aug. 4, 2017 discloses a multi-unit coin ejection apparatus, which comprises a plurality of coin ejection units and a plurality of coin storing containers respectively placed on the coin ejection units. Each of the coin ejection units are configured in such a way that coins stored in a corresponding one of the coin storing containers are ejected by a rotating disk placed just below the said container through a corresponding coin outlet. The coin ejection units, which are assigned to the respective denominations of coins, are driven in synchronization with each other by a single motor. When a dispensing instruction is received, coins of one or more necessary denominations for the instruction are ejected from one or more of the coin ejection units. In each of the coin ejection units, the control for selectively ejecting one or more coins of the assigned denomination in response to a dispensing instruction is realized by a shutter provided near the coin outlet. The shutter is formed by a passage preventing member provided movably in a through hole of the disk. The passage preventing member is configured in such a way as to protrude from the surface of the disk and sink below the same. When preventing the coin ejection, the passage preventing member is moved to protrude from the surface of the disk. When permitting the coin ejection, the passage preventing member is moved to sink below the surface of the disk. In this way, the control for selectively ejecting one or more coins of the assigned denomination in each of the coin ejection units in response to a dispensing instruction is realized using the shutter.

As the control method for electively ejecting one or more coins of the assigned denomination in each of the coin ejection units of a multi-unit coin ejection apparatus, another control method which is different from the aforementioned method of Publication No. 6182787 using the shutter is disclosed in Japanese Examined Patent Publication No. 2514825 issued on Apr. 30, 1996. With the control method of Publication No. 2514825, a desired dispensing operation is selectively carried out in one of two coin ejection units by controlling the rotation direction of a rotation shaft, in other words, by switching the rotation direction of a rotation shaft between the forward direction and the reverse direction.

With the aforementioned multi-unit coin ejection apparatus disclosed in Publication No. 6182787, since the coin ejection units, which are assigned to the respective denominations of coins, are driven by a single motor in synchronization with each other, there is an advantage that the cost for the motor can be reduced compared with the case where each of the coin ejection units is driven by its own motor. However, to realize the control for selectively ejecting one or more coins of the assigned denomination in each of the coin ejection units of a multi-unit coin ejection apparatus in response to a dispensing instruction, it is required to provide the shutter near the coin outlet of each of the coin ejection units and to control the open/close operation of the shutter in response to a dispensing instruction. However, the structure of the shutter is considerably complicated and at the same time, the control of the shutter needs to be precisely and thus, there are the disadvantages that the shutter is likely to malfunction and is likely to have insufficient durability. Accordingly, it is necessary to find or create a measure for solving or avoiding these disadvantages.

With the control method disclosed by the aforementioned Publication No. 2514825, since a desired dispensing operation is selectively carried out in one of the two coin ejection units by switching the rotation direction of a rotation shaft between the forward direction and the reverse direction, the aforementioned shutter is unnecessary. Thus, the structure of each of the coin ejection units is highly simplified and is unlikely to malfunction. Moreover, the aforementioned disadvantage about the durability also can be solved easily.

However, there arises another problem that the number of usable coin ejection units is limited to two. To control three or more coin ejection units using the aforementioned control method of Publication No. 2514825, it is necessary to provide two or more of the control mechanisms for switching the rotation direction of the respective rotation shafts between the forward and backward directions. This means that the overall structure of the plurality of control mechanisms is so complicated that the aforementioned advantages of this method, i.e., structural simplification, unlikely malfunction, and sufficient durability are lost.

SUMMARY OF THE INVENTION

The present invention was created while taking the aforementioned circumstances into consideration.

Accordingly, an object of the present invention is to provide a multi-unit coin ejection apparatus that makes it possible to selectively eject one or more coins of one or more necessary denominations from coin ejection units in response to a dispensing instruction without using a mechanism for selectively ejecting one or more coins of a predetermined denomination which is provided in each of coin ejection units, such as the aforementioned shutter of Publication No. 6182787, in the case where a structure that drives or activates coin ejection units with a single motor is employed.

Another object of the present invention is to provide a multi-unit coin ejection apparatus that makes it possible to simplify the structure of each of the coin ejection units, to produce the coin ejection units at low cost, to be unlikely to malfunction, and to be able to have desired durability easily.

The above objects together with others not specifically mentioned here will become clear to those skilled in the art from the following description.

A multi-unit coin ejection apparatus according to the present invention comprises:

a base having a mounting surface;

coin ejection units mounted on the mounting surface;

a first motor commonly used for the coin ejection units;

a driving mechanism, provided below the mounting surface, that is configured to drive the coin ejection units by transmitting a driving force of the first motor using gears; and a switching unit, provided below the mounting surface, that is configured to switch a destination of the driving force of the first motor, thereby selectively driving one of the driving the coin ejection units;

wherein the switching unit comprises (i) first coupling gears which are respectively provided for the coin ejection units, (ii) second coupling gears which are engageable with the corresponding first coupling gears and which are provided for the driving mechanism, and (iii) a coupling gear displacement mechanism that is configured to displace the second coupling gears between a predetermined connection position and a predetermined non-connection position;

the coupling gear displacement mechanism is operated in response to an instruction in such a way that a designated one of the second coupling gears is disposed at the connection position and that a remainder of the second coupling gears is/are disposed at the non-connection position in accordance with the instruction; and when a designated one of the second coupling gears is disposed at the connection position by the coupling gear displacement mechanism in response to an instruction, the driving force of the first motor is selectively transmitted to a corresponding one of the coin ejection units to the designated one of the second coupling gears.

With the multi-unit coin ejection apparatus according to the present invention, as explained above, the coin ejection units, which are mounted on the mounting surface of the base, are structured in such a way that one of the coin ejection units is selectively driven by switching the transmission destination of the driving force of the first motor using the switching unit. The switching unit comprises (i) the first coupling gears respectively provided for the coin ejection units, (ii) the second coupling gears provided for the driving mechanism to be engageable with the corresponding first coupling gears, and (iii) the coupling gear displacement mechanism that displaces the second coupling gears between the predetermined connection position and the predetermined non-connection position. Moreover, the coupling gear displacement mechanism is operated in response to an instruction in such a way that a designated one of the second coupling gears is disposed at the connection position and that a remainder of the second coupling gears is/are disposed at the non-connection position in accordance with the instruction.

Accordingly, when a designated one of the second coupling gears is disposed at the connection position by the coupling gear displacement mechanism in response to an instruction, since the remainder of the second coupling gears is/are disposed at the non-connection position, the driving force of the first motor is selectively transmitted to one of the coin ejection units corresponding to the designated one of the second coupling gears. This means that only the coin ejection unit to which the driving force of the first motor is transmitted can be driven to eject one or more coins of a predetermined denomination in accordance with the instruction, Therefore, it is unnecessary to control the permission and prevention of coin ejection in each of the coin ejection units individually in the case where the coin ejection units are configured to be driven by the first motor alone.

As a result, with the multi-unit coin ejection apparatus according to the present invention, it is unnecessary to provide a mechanism for selectively ejecting one or more coins of a predetermined denomination which is provided in each of coin ejection units, such as the aforementioned shutter of Publication No. 6182787, in the case where a structure that drives or activates coin ejection units with a single motor is employed.

Moreover, the switching unit can be formed by (i) the first coupling gears which are respectively provided for the coin ejection units, (ii) the second coupling gears which are engageable with the corresponding first coupling gears and which are provided for the driving mechanism, and (iii) the coupling gear displacement mechanism that is configured to displace the second coupling gears between the predetermined connection position and the predetermined non-connection position, and the engagement and disengagement between the first coupling gears and the corresponding second coupling gears can be carried out by simply operating or manipulating the coupling gear displacement mechanism. Accordingly, a simple structure which can be produced at low cost, such as a rotationally driven camshaft with cams, can be used for the coupling gear displacement mechanism. Furthermore, as described above, it is unnecessary to provide a mechanism that controls the permission and prevention of coin ejection in each of the coin ejection units individually.

Accordingly, the structure of each of the coin ejection units is simplified and the coin ejection units can be produced at low cost. In addition, the coin ejection units are unlikely to malfunction and are able to have desired durability easily.

In a preferred embodiment of the multi-unit coin ejection apparatus according to the present invention, each of the first coupling gears is formed by a gear which is fixed to a rotation shaft of a corresponding one of the coin ejection units and which has teeth and grooves formed on one side face thereof; and each of the second coupling gears is formed by a gear which is fixed to a corresponding linking gear (e.g., a driven gear) of the driving mechanism and which has teeth and grooves formed on one side face thereof to be engageable respectively with the grooves and the teeth of a corresponding one of the first coupling gears.

In another preferred embodiment of the multi-unit coin ejection apparatus according to the present invention, the coupling gear displacement mechanism comprises:

a camshaft rotationally driven by a second motor, wherein the camshaft has cams which are assigned to the respective coin ejection units; and cam followers which are respectively engaged with the second coupling gears and which are displaceable by the corresponding cams;

wherein the second coupling gears are displaced between the connection position and the non-connection position according to displacements of the cam followers due to rotations of the corresponding cams.

In still another preferred embodiment of the multi-unit coin ejection apparatus according to the present invention, there are provided with sensors that detect a rotational position of the camshaft; and the coupling gear displacement mechanism judges which one of the second coupling gears is disposed at the connection position based on the detected rotational position of the camshaft by the sensors.

In a further preferred embodiment of the multi-unit coin ejection apparatus according to the present invention, detection members are fixed to the camshaft in a one-by-one correspondence to the cams;

sensors that detect respectively rotational positions of the detection members are provided at corresponding positions to the detection members; and the coupling gear displacement mechanism judges which one of the second coupling gears is disposed at the connection position based on the detected rotational positions of the detection member by the sensors.

In a further preferred embodiment of the multi-unit coin ejection apparatus according to the present invention, a non-operable mode where the driving force of the first motor is not transmitted to all of the coin ejection units is provided in addition to an operable mode where the driving force of the first motor is transmitted to any one of the coin ejection units; and the non-operable mode and the operable mode are configured to be switchable according to the necessity.

In a further preferred embodiment of the multi-unit coin ejection apparatus according to the present invention, the coupling gear displacement mechanism is configured to be rockable around a shaft which is supported by the base;

an operable mode where the driving force of the first motor is transmitted to any one of the coin ejection units and a non-operable mode where a driving force of the first motor is not transmitted to all of the coin ejection units are provided; and the operable mode and the non-operable mode are configured to be switchable by a rocking motion of the coupling gear displacement mechanism around the shaft.

In a further preferred embodiment of the multi-unit coin ejection apparatus according to the present invention, a non-operable mode where the driving force of the first motor is not transmitted to all of the coin ejection units is provided in addition to an operable mode where the driving force of the first motor is transmitted to any one of the coin ejection units;

all of the coin ejection units are configured to be detachable from the base by a motion along the mounting surface; and the coin ejection units can be selectively detached from the base by sliding a desired one or ones of the coin ejection units along the mounting surface in the non-operable mode.

BRIEF DESCRIPTION OF THE DRAWINGS

In order that the present invention may be readily carried into effect, it will now be described in detail with reference to the accompanying drawings.

DETAILED DESCRIPTION OF THE INVENTION

Figure 1:
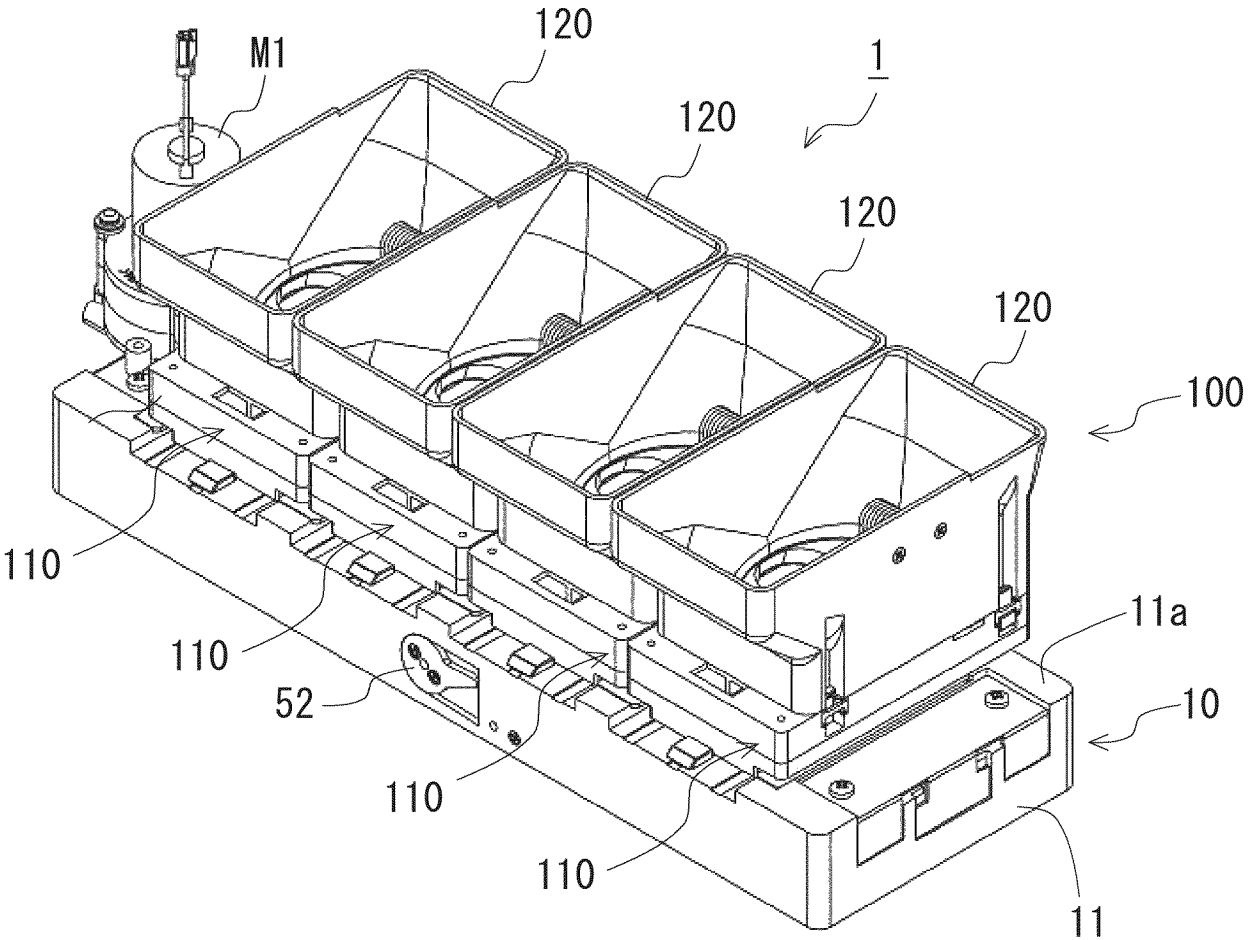
FIG. 1 is a perspective view showing the overall structure of a multi-unit coin ejection apparatus according to an embodiment of the present invention, in which the state where lids of coin storing containers are removed is shown.

Preferred embodiments of the present invention will be described in detail below while referring to the drawings attached.

Structure of Multi-Unit Coin Ejection Apparatus 1

Figure 2:
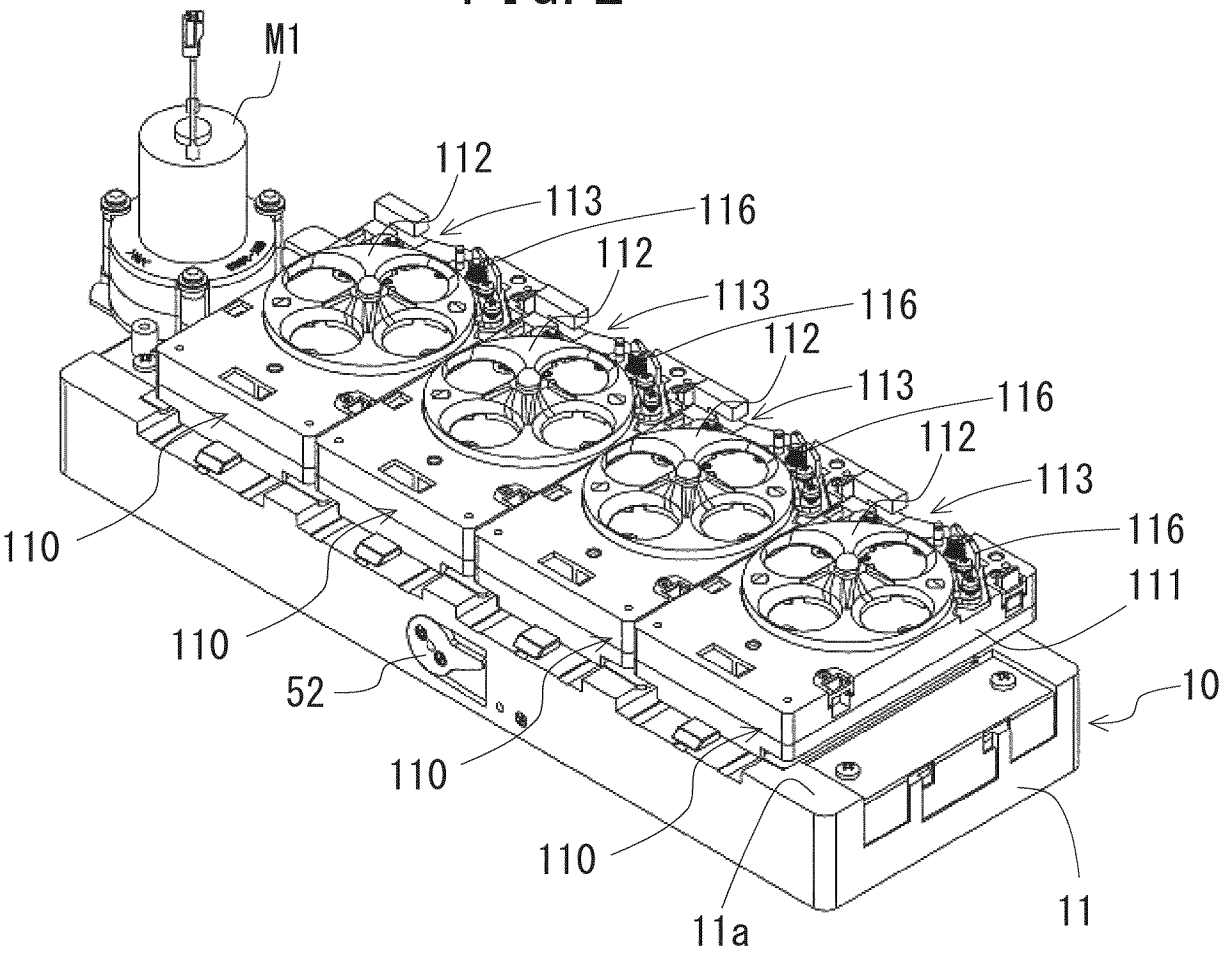
FIG. 2 is a perspective view showing the state where four coin storing containers are detached from the multi-unit coin ejection apparatus of FIG. 1.
Figure 3:
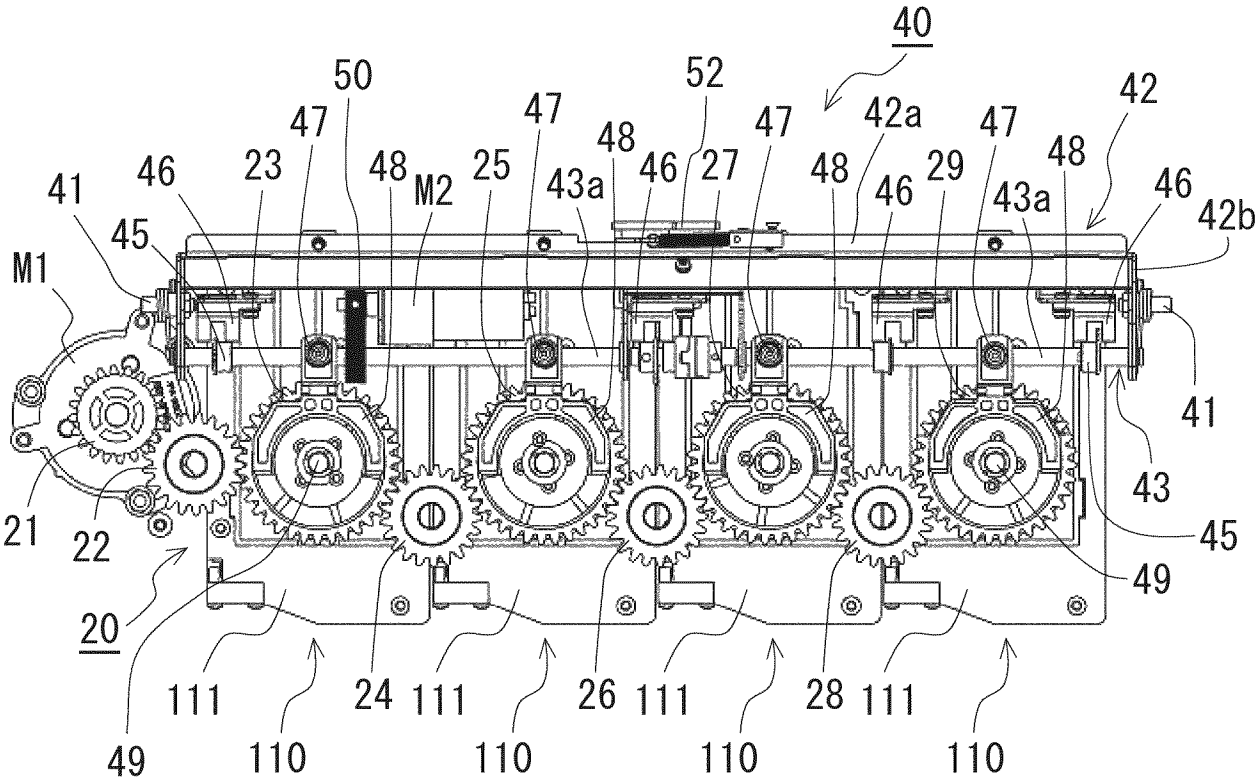
FIG. 3 is a bottom view showing the structure of a driving mechanism and a switching unit, both of which are provided in a chassis or base of the multi-unit coin ejection apparatus of FIG. 1.
Figure 4:
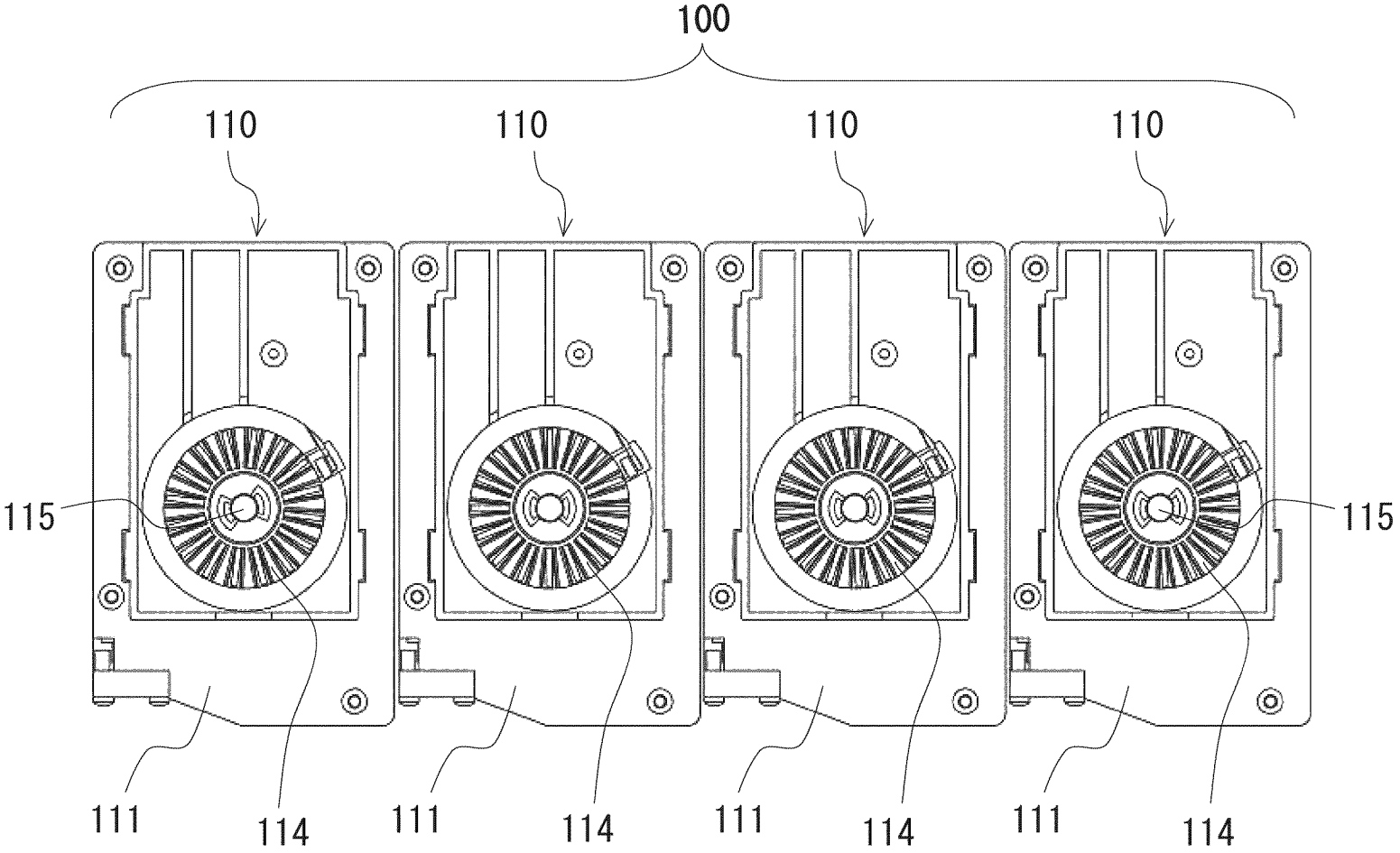
FIG. 4 is a bottom view showing the structure of the four coin ejection units of the multi-unit coin ejection apparatus of FIG. 1.

The overall schematic structure of a multi-unit coin ejection apparatus 1 according to an embodiment of the present invention is shown in FIG. 1, Moreover, the state where four coin storing containers 120 are detached from the multi-unit coin ejection apparatus 1 is shown in FIG. 2, the schematic structures of a driving mechanism 20 and a switching unit 40 which are provided in a chassis 11 of the apparatus 1 are shown in FIG. 3, and the structure of first to fourth coin ejection units 110 is shown in FIG. 4.

As shown in FIG. 1, the multi-unit coin ejection apparatus 1 according to the embodiment of the present invention is mainly formed by a base section 10 and a coin ejection section 100.

The base section 10 comprises the chassis 11 which has a shape like a rectangular parallelepiped, and the approximately rectangular upper surface of the chassis 11 is formed as a mounting surface 11*a*. The multi-unit coin ejection apparatus 1 is placed in such a way that the mounting surface 11*a* is approximately parallel to the horizontal plane.

The coin ejection section 100 comprises the first to fourth coin ejection units 110, each of which has a corresponding one of the four coin storing containers 120 and a lid (not shown) that covers the upper opening of the said container 120. The first to fourth coin ejection units 110 are arranged on the mounting surface 11*a* to be adjacently to each other along a straight line parallel to the long sides of the mounting surface 11*a* and are disengageably engaged with the mounting surface 11*a*, A first motor M1 for conducting the coin ejection operation by driving the respective coin ejection units 110 is fixed to one end of the chassis 11. The rotational shaft (not shown) of the first motor M1 is disposed so as to be perpendicular to the mounting surface 11*a*. The control of the first motor M1, i.e., the start and stop of rotation and the switching of the rotation direction between the normal and reverse directions, is performed by a control device (not shown).

As the first motor M1, any known motor can be used if it has a rotational driving force sufficient for driving (the rotating disk of) each of the first to fourth coin ejection units 110 to conduct the predetermined coin ejection operation.

In the following explanation, the unit 110 disposed at the nearest position to the first motor M1 is termed the "first coin ejection unit", and the remaining three units 110 arranged in this order in a direction away from the first coin ejection unit 110 along the long sides of the mounting surface 11*a* are respectively termed the "second coin ejection unit", the "third coin ejection unit", and the "fourth coin ejection unit".

The first to fourth coin ejection units 110 are respectively assigned to predetermined four denominations (for example, in the case of Japanese Yen, four denominations of 500 Yen, 100 Yen, 50 Yen, and 10 Yen). Thus, these four coin ejection units 110 are configured in such a way that coins of a relevant denomination are stored in the coin storing container 120 of a corresponding one of the units 110. Each of the coin ejection units 110 ejects the coins of the relevant denomination stored in the corresponding coin storing container 120 to the outside one by one in response to a dispensing instruction which is sent from an upper-level device (for example, a coin depositing/dispensing apparatus).

Figure 5:
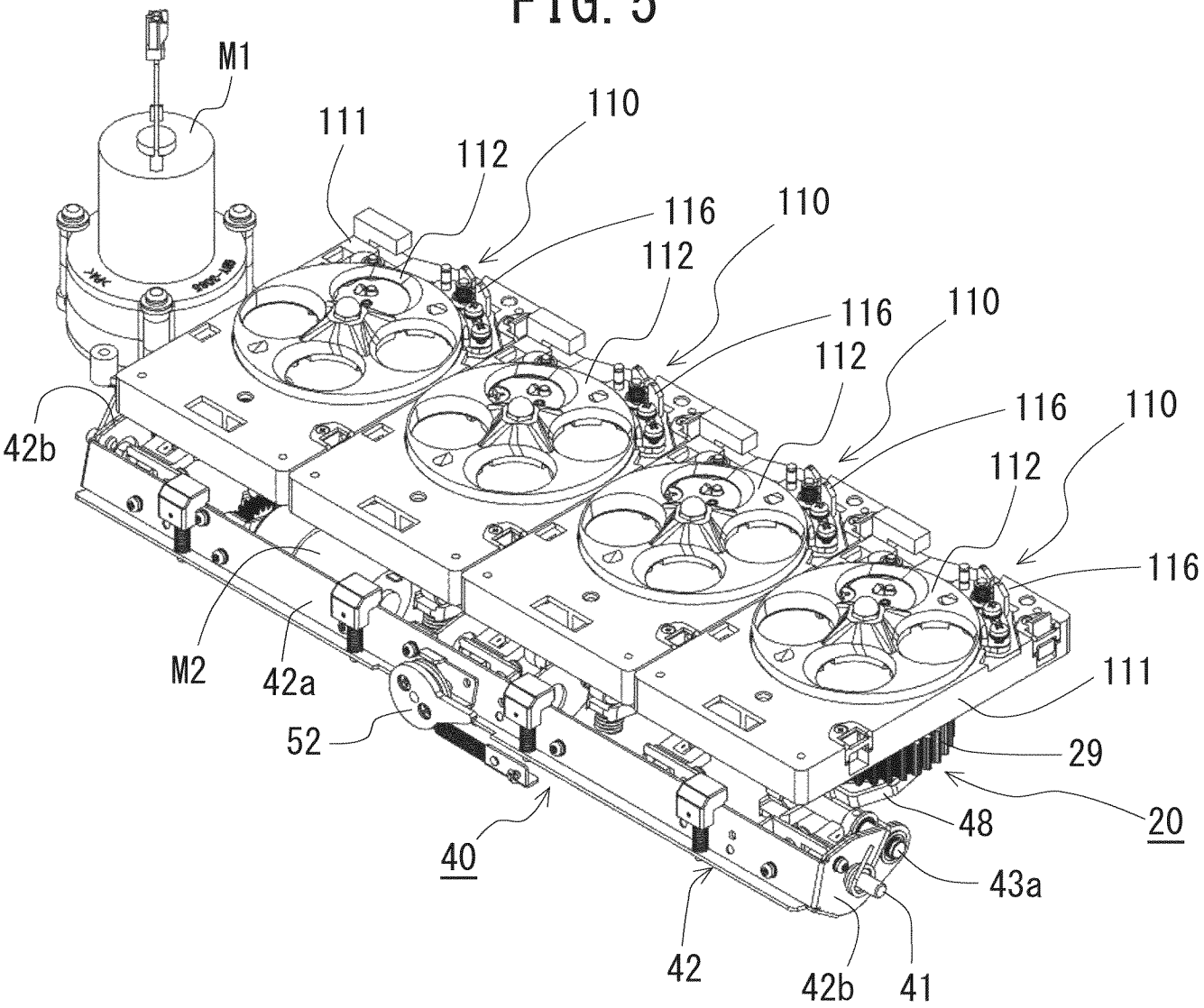
FIG. 5 is a perspective view showing the state where the four coin storing containers and the chassis or base are detached from the multi-unit coin ejection apparatus of FIG. 1.

The first to fourth coin ejection units 110 have the same structure. As shown in FIGS. 2 and 5, each of the units 110 comprises a plate-shaped body 111, and a disk 112 which has four through holes and which is mounted so as to be rotatable in the body 111. Since the mounting surface 11*a* is approximately horizontal, the disk 112 is rotatable in an approximately horizontal plane. If a coin of a relevant denomination which has been dropped from the corresponding coin storing container 120 is fitted into one of the through holes of the disk 112 during rotation, the said coin is thrown out of the hole by an inertial force caused by the rotation of the disk 112 and as a result, the said coin is ejected to the outside through an ejection outlet 113 provided at the rear end of the body 111. In addition, at the time of coin ejection, the said coin thus thrown out of the corresponding hole is controlled so as to abut on a coin guide 116 provided near the ejection outlet 113: as a result, the ejection direction of said coin is always controlled in a predetermined direction.

Needless to say, the count of the through holes of the disk 112 is not limited to four and it may be set as any number other than four. Moreover, it is needless to say that the disks 112 provided for all the denominations to be ejected need not have the same structure (i.e. which have an equal count of the holes) and that the disks 112 may have different structures (i.e. which have different counts of the holes) according to the assigned denominations.

In each of the first to fourth coin ejection units 110, a rotational shaft 115 that extends approximately vertically and that is rotatably supported is provided in the body 111. The disk 112 is engaged with the top end of the shaft 115. As shown in FIG. 4, a coupling gear 114 is fixed to the lower end of the shaft 115 and thus, the coupling gear 114 and the disk 112 are rotated integrally along with the rotation of the shaft 115. This means that the coupling gear 114 also is rotated in the approximately horizontal plane similar to the disk 112.

As shown in FIG. 3, in the chassis 11, a driving mechanism 20 that selectively drives rotationally one of the disks 112 in the first to fourth coin ejection units 110 by transmitting the driving force of the first motor M1, and a switching unit 40 that switches the transmission destination of the rotational driving force of the first motor M1 to selectively drive one of the first to fourth coin ejection units 110 are provided.

The structure of the driving mechanism 20 is shown in FIG. 3 and FIGS. 6 to 9. Specifically, the driving mechanism 20 comprises a plurality of gears that are arranged approximately linearly along the long sides of the chassis 11. More specifically, the driving mechanism 20 comprises (i) a driving gear 21 fixed to the rotational shaft of the first motor M1; (ii) four driven gears 23, 25, 27, and 29 that are respectively fixed to the lower ends of the rotational shafts 115 of the first to fourth coin ejection units 110; (iii) an intermediate gear 22 rotatably placed between the driving gear 21 and the driven gear 23 for the first coin ejection unit 110; (iv) an intermediate gear 24 rotatably placed between the driven gear 23 for the first coin ejection unit 110 and the driven gear 25 for the second coin ejection unit 110; (v) an intermediate gear 26 rotatably placed between the driven gear 25 for the second coin ejection unit 110 and the driven gear 27 for the third coin ejection unit 110; (vi) and an intermediate gear 28 rotatably placed between the driven gear 27 for the third coin ejection unit 110 and the driven gear 29 for the fourth coin ejection unit 110.

All of the driven gears 23, 25, 27, and 29 and the intermediate gears 22, 24, 26, and 28 are located in a plane parallel to the mounting surface 11*a* (i.e., an approximately horizontal plane) and are arranged along the straight line parallel to the long sides of the mounting surface 11*a* (along which the first to fourth coin ejection units 110 are arranged). The driven gears 23, 25, 27, and 29 and the intermediate gears 22, 24, 26, and 28 are rotatable integrally along with the corresponding eight rotational shafts (not shown) which are rotatably supported in the chassis 11, respectively. As easily understood from the structure of the driving mechanism 20, all of the driven gears 23, 25, 27, and 29 prepared respectively for the first, second, third, and fourth coin ejection units 110 are rotated in the same direction as the driving gear 21.

As shown in FIGS. 6 to 9, coupling gears 30, 31, 32, and 33 (which correspond to the second coupling gears) are respectively fixed onto the upper surfaces (upper side faces) of the driven gears 23, 25, 27, and 29 of the first to fourth coin ejection units 110. These coupling gears 30, 31, 32, and 33 are rotated integrally along with the corresponding driven gears 23, 25, 27, and 29, respectively. Moreover, the coupling gears 30, 31, 32, and 33 are disengageably engaged with corresponding four coupling gears 114 (see FIG. 4) (which correspond to the first coupling gears) fixed to the corresponding rotational shafts 115 of the first, second, third, and fourth units 110, respectively. These four coupling gears 30, 31, 32, and 33 are selectively engaged with the corresponding four coupling gears 114 or disengaged from the same by the switching unit 40. Due to this selective engagement and disengagement, the first to fourth coin ejection units 110 as the transmission destination of the driving force of the first motor M1 is switched.

The switching unit 40 has the structure shown in FIGS. 6 to 9. Specifically, the switching unit 40 comprises an approximately bar-shaped frame 42 formed by combining a plurality of thin plates, a camshaft 43 rotatably supported by the frame 42, and a second motor M2 supported by the frame 42. Four cams 44 and four detection members 45 are fixed to the camshaft 43. The second motor M2 is used for rotationally driving the camshaft 43. The frame 42 and the camshaft 43 are parallel to each other and are extended along the aforementioned straight line (along which the first to fourth coin ejection units 110 are arranged), The total length of the frame 42 and that of the camshaft 43 are approximately the same as that of the space that encloses the driven gears 23, 25, 27, and 29 and the intermediate gears 22, 24, 26*d*, and 28. The second motor M2 has a driving gear 50 which is fixed to a rotational shaft (not shown) of the motor M2 (see FIG. 8). The driving gear 50 is rotatably engaged with the driven gear 51 which is fixed to the camshaft 43 at the position opposing to the driving gear 50. The camshaft 43 is rotationally driven by the rotational driving force of the second motor M2.

The frame 42 comprises a belt-shaped frame body 42*a* and four supporting parts 42*b*. The frame body 42*a* is extended over the whole length of the frame 42. All of the four supporting parts 42*b* are formed to protrude perpendicularly from the frame body 42*a* in the same direction. Two of the supporting parts 42*b* are disposed at a predetermined distance near the middle position of the frame body 42*a*. The remaining two supporting parts 42*b* are disposed at the two end positions of the frame body 42*a*, respectively. Two supporting shafts 41 are fixed to the two supporting parts 42*b* disposed at the end positions in the outside of the frame 42, respectively. These two supporting shafts 41 are protruded in opposite directions from the corresponding supporting parts 42*b* along the extending direction of the frame 42 and the camshaft 43, and rotatably supported by two supporting members (not shown) fixed in the chassis 11, respectively. For this reason, the entire frame 42 can be rocked around the two supporting shafts 41 disposed at the ends of the frame 42. Due to this rocking motion of the frame 42, the camshaft 43 also is rocked around the two supporting shafts 41 to be displaced. The second motor M2, which is disposed between the camshaft 43 and the frame body 42*a* at the position approximately opposite to the intermediate gear 24, is fixed to the inner surface of the frame body 42*a*.

In this embodiment, the camshaft 43 is formed by coupling two shaft members 43*a* with a joint or connector 43*b*. One of the shaft members 43*a* is rotatably supported by the two supporting parts 42*b* disposed at the right side half of the frame body 42*a*, and the other of the shaft members 43*a* is rotatably supported by the two supporting parts 42*b* disposed at the left side half of the frame body 42*a*. However, this structure is used for facilitating the assembly. Thus, it is needless to say that the camshaft 43 may be formed by a single shaft member.

As the second motor M2, a known servo motor or stepping motor may be used. However, the present invention is not limited to these motors. It is needless to say that any motor may be used for the second motor M2 if it can control precisely the rotational position or rotational angle of the camshaft 43.

The start and stop of the rotation of the second motor M2 and the switching of the rotation direction thereof between the forward and backward directions, which are performed by an unillustrated control device, can be appropriately adjusted according to the arrangement of the four cams 44 on the camshaft 43. For example, the second motor M2 is usually configured to be rotated in the forward and backward directions; however, the second motor M2 may be configured to be rotated only in one direction (i.e., only the forward or backward direction).

The four cams 44 fixed to the camshaft 43 are respectively prepared for the first to fourth coin ejection units 110. These cams 44 are the same in shape and size as each other, Each of the cams 4 is formed by a member with a predetermined thickness which has a shape like an isosceles triangle whose three corners are rounded. As seen from FIG. 6, these four cams 44 are fixed to the camshaft 43 in such a way as to shift sequentially at a phase difference of 90°. This is to make it possible to selectively switch the transmission destination of the driving force of the first motor M1 among the first to fourth coin ejection units 110 by changing the rotational position or angle of the camshaft 43.

The four cams 44 are configured to cooperate with the four cam followers 48 (see FIGS. 7 and 8) which are respectively engaged with the corresponding driven gears 23, 25, 27, and 29 provided respectively for the first to fourth coin ejection units 110.

Figure 10A:
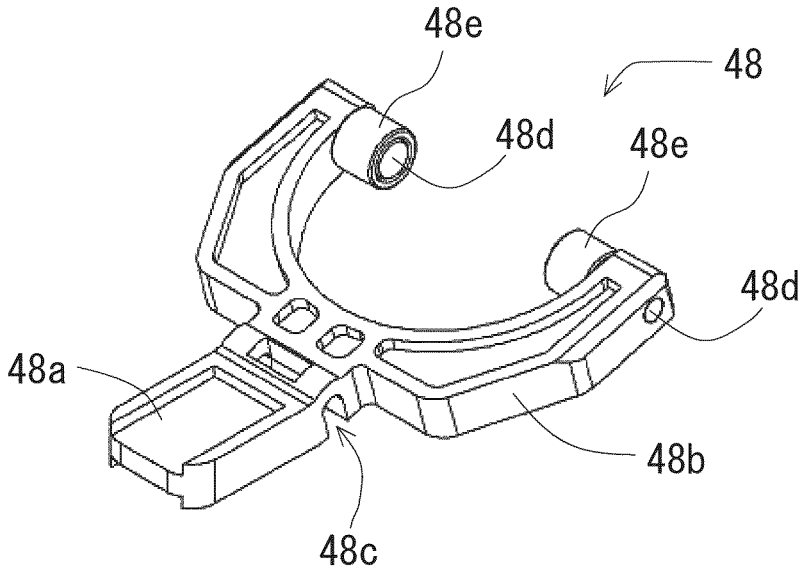
FIG. 10A is a perspective view showing an example of the structure of a cam follower used for the switching unit of the multi-unit coin ejection apparatus of FIG. 1, which is seen obliquely downward from the upper right front.
Figure 10B:
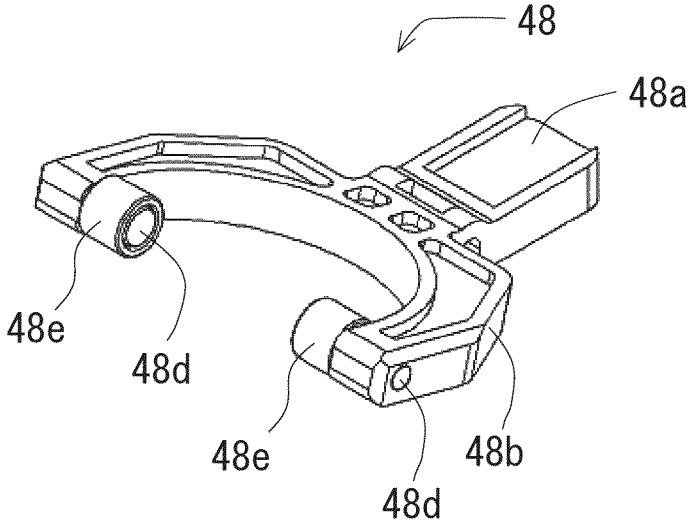
FIG. 10B is a perspective view showing the example of the structure of the cam follower used for the switching unit of the multi-unit coin ejection apparatus of FIG. 1, which is seen obliquely downward from the upper right rear.

The four cam followers 48 have the function of displacing the corresponding driven gears 23, 25, 27, and 29 in upper and lower directions. These four cam followers 48 are the same in shape and size, each of which has the structure shown in FIGS. 10A and 10B. Specifically, each of the cam followers 48, the entire shape of which is like a Y character, comprises a cam receiving part 48*a* and a branching part 48*b*. The cam receiving part 48*a* is a part for receiving the corresponding cam 44. The branching part 48*b* is a part that is engaged with an engagement member (e.g., an engagement member 23*a* shown in FIGS. 12A and 12B) mounted on a corresponding one of the driven gears 23, 25, 27, and 29. A shaft hole 48*c* is formed near the boundary between the cam receiving part 48*a* and the branching part 48*b*. When the cam reeving part 48*a* is pressed downward by the protruding part of the corresponding cam 44, the cam follower 48 is rocked around a support shaft 48*f* (see FIG. 12A) which is fit in the shaft hole 48*c* and as a result, the branching part 48*b* is pressed upward. When the downward pressing force to the cam reeving part 48*a* by the protruding part of the corresponding cam 44 is lost, the cam follower 48 is returned to its initial position by the elastic force of a corresponding spring 47 (see FIGS. 7 and 8) disposed right below the cam reeving part 48*a*. This means that the cam follower 48 is rocked around the support shaft 48*f* (or the shaft hole 48*c*) like a seesaw in response to the presence or absence of the downward pressing force applied to the cam reeving part 48*a*.

Two pins 48*d* are respectively fixed inwardly to the ends of two arms that forms the branching part 48*b* of the cam follower 48. Two rollers 48*e* are rotatably engaged with these two pins 48*d*, respectively. The reason why the rollers 48*e* are provided is to realize the smooth engagement operation of the cam follower 48 with the engagement member (e.g., the engagement member 23*a*) mounted on the corresponding one of the driven gears 23, 25, 27, and 29.

Figure 11A:
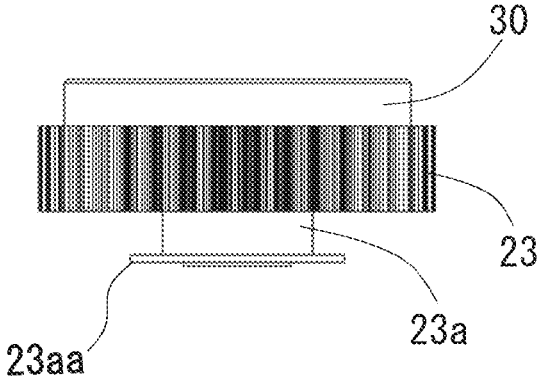
FIG. 11A is a front view showing an example of the structure of a coupling gear used for the switching unit of the multi-unit coin ejection apparatus of FIG. 1, which shows the state where the coupling gear is fixed to an upper surface of a corresponding driven gear.
Figure 11B:
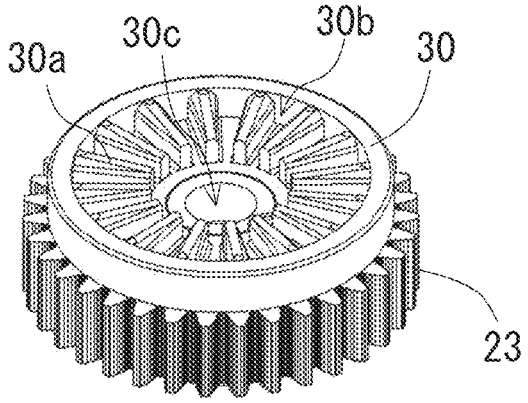
FIG. 11B is a perspective view showing the example of the structure of the coupling gear used for the switching unit of the multi-unit coin ejection apparatus of FIG. 1, which is seen obliquely downward from an upper position.
Figure 11C:
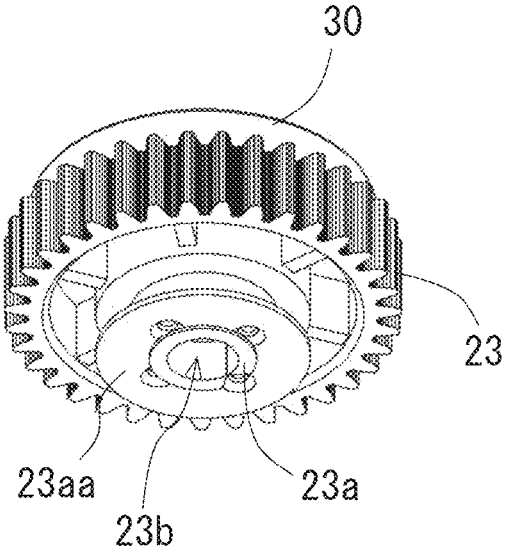
FIG. 11C is a perspective view showing the example of the structure of the driven gear used for the switching unit of the multi-unit coin ejection apparatus of FIG. 1, which is seen obliquely upward from a lower position.

FIGS. 11A, 11B, and 11C show an example of the structure of the engagement member 23*a* mounted on the driven gear 23 for the first coin ejection unit 110, in which the coupling gear 30 is fixed to the driven gear 23.

As seen from FIGS. 11A, 11B, and 110, the coupling gear 30, the diameter of which is slightly smaller than the driven gear 23, is fixed to the upper side face (upper surface) of the driven gear 23 in such a way as to be coaxial with the same gear 23. The engagement member 23*a* having an approximately cylindrical shape is fixed to the lower side face (lower surface) of the driven gear 23 in such a way as to protrude downward. The engagement member 23*a*, which is fixed to be coaxial with the driven ear 23, has a flange part 23*aa* that protrudes laterally at the lower end thereof. The flange part 23*aa* forms one of the engagement faces for the branching part 48*b*. The lower side face of the driven gear 23 forms the other of the engagement faces for the branching part 48*b*. The branching part 48*b* is inserted between the flange part 23*aa* and the lower surface of the driven gear 23 to be engaged with the same. The engagement member 23*a* has a shaft hole 23*b* which is coaxial with the corresponding driven gear 23 and the corresponding coupling gear 30. The two rollers 48*e*, which are attached to the two ends of the branching part 48*b* of the cam follower 48, are engaged with the part which is sandwiched by the flange part 23*aa* and the lower surface of the driven gear 23. While the branching part 48*b* of the cam follower 48 is rocked upward or downward around the support shaft 48*f*, the rollers 48*e* are rolled, thereby realizing smooth movement of the driven gear 23 and the coupling gear 30 between the connection position and the non-connection position.

Figure 7:
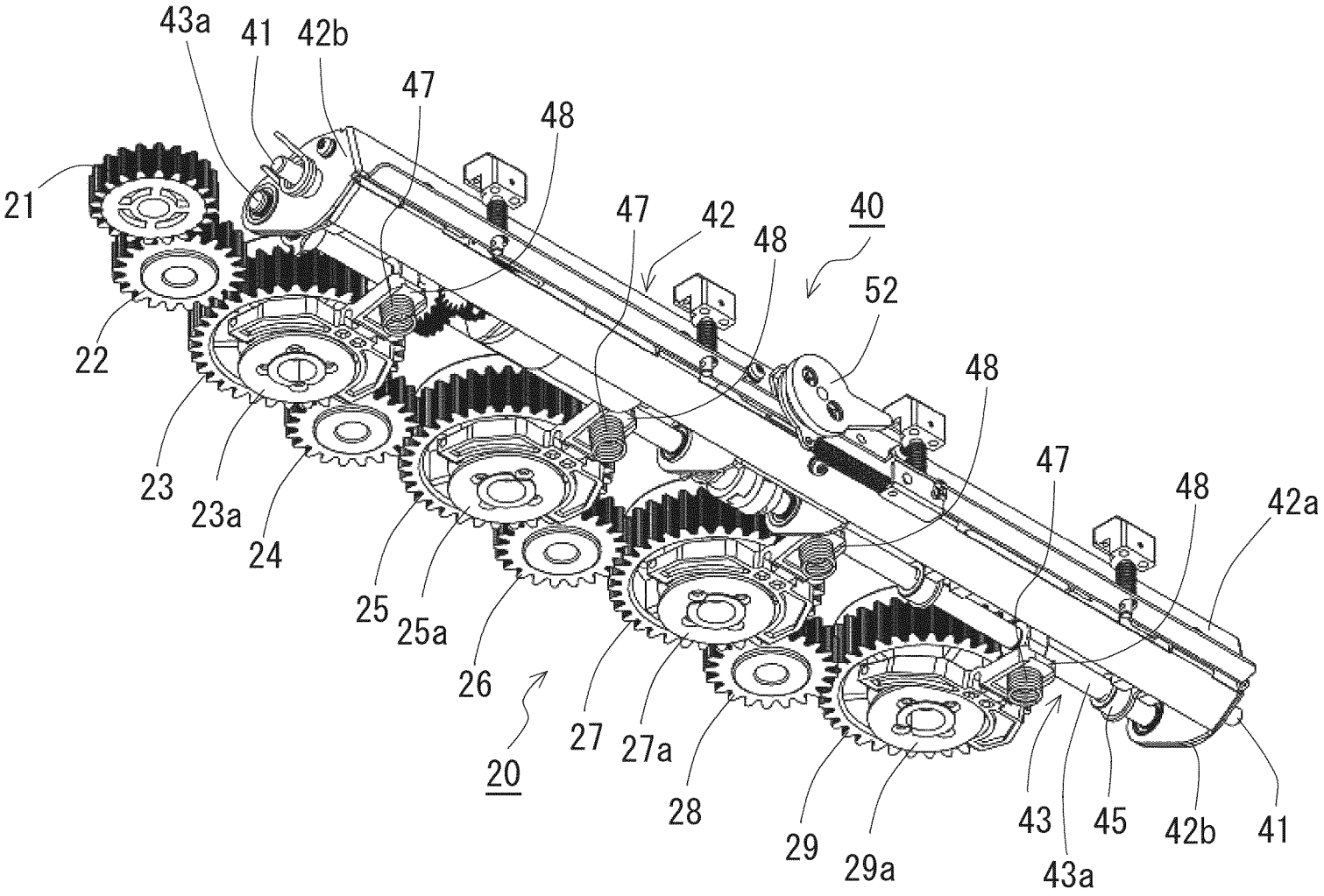
FIG. 7 is a perspective view showing the structure of the driving mechanism and the switching unit of the multi-unit coin ejection apparatus of FIG. 1, which is seen obliquely upward from the lower left front.
Figure 8:
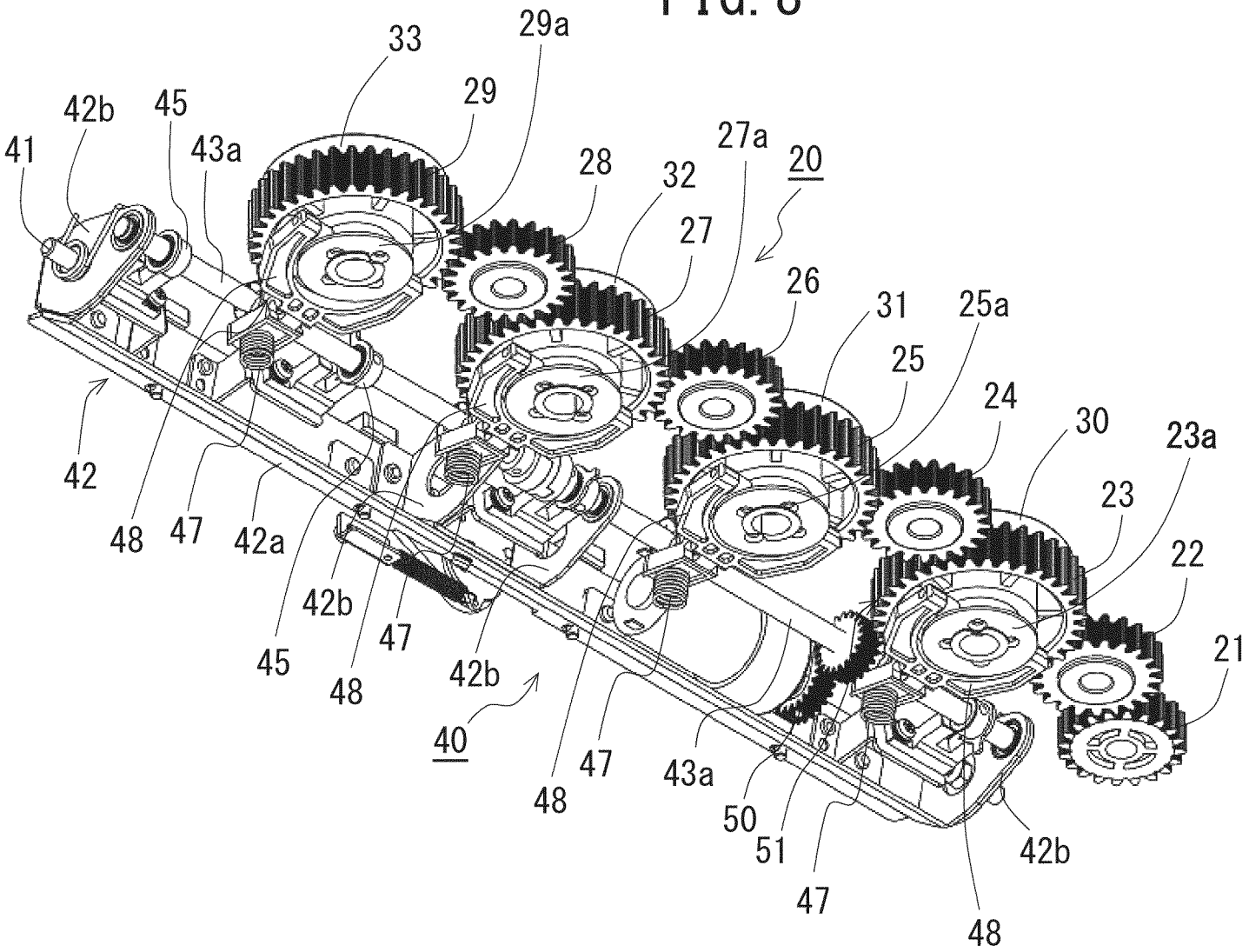
FIG. 8 is a perspective view showing the structure of the driving mechanism and the switching unit of the multi-unit coin ejection apparatus of FIG. 1, which is seen obliquely upward from the lower left rear.
Figure 9:
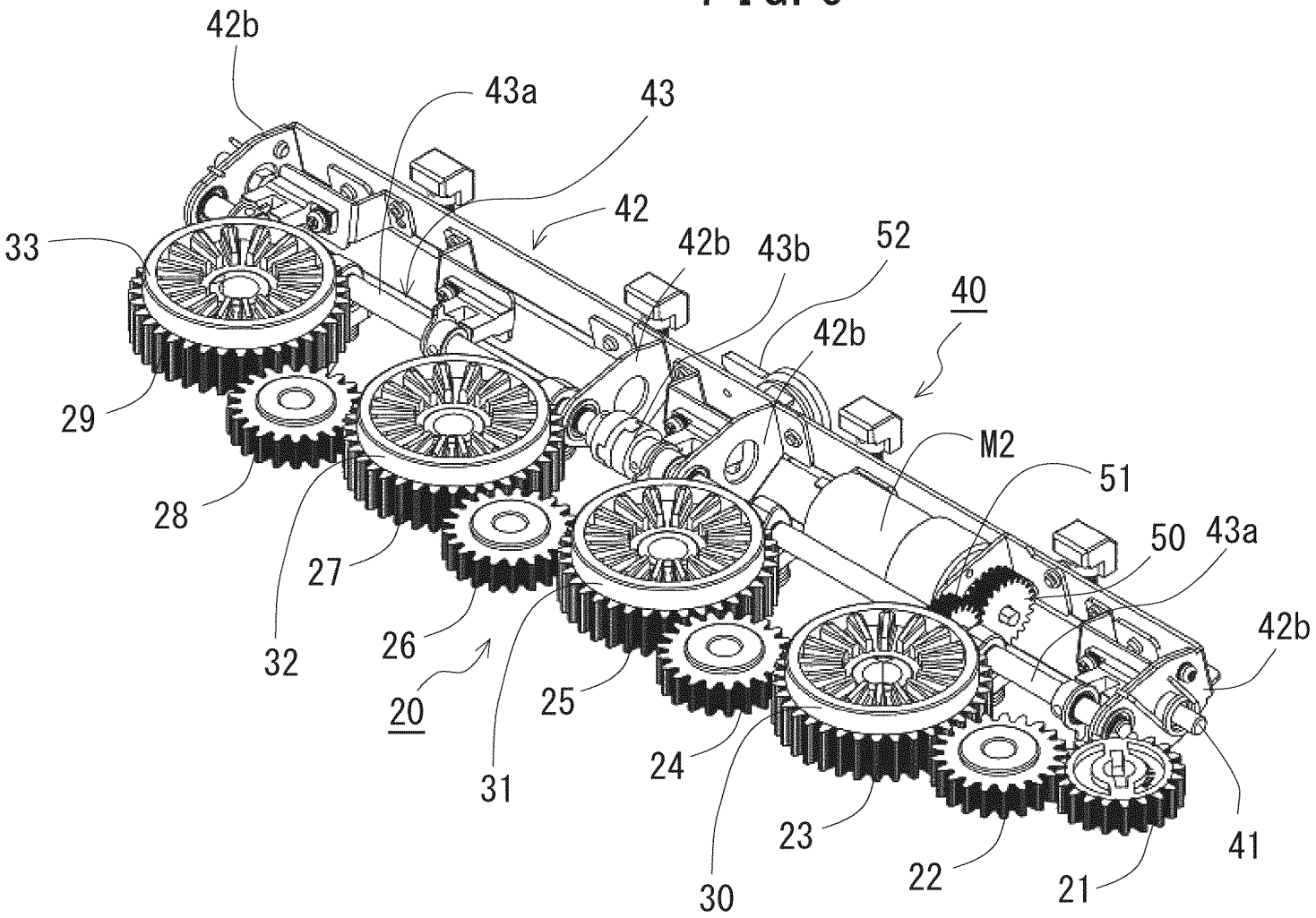
FIG. 9 is a perspective view showing the structure of the driving mechanism and the switching unit of the multi-unit coin ejection apparatus of FIG. 1, which is seen obliquely downward from the upper right rear.

The aforementioned is applicable to the driven gears 25, 27, and 29. As shown in FIG. 7, engagement members 25*a*, 27*a*, and 29*a* each having an approximately cylindrical shape are respectively mounted on the driven gears 25, 27, and 29 for the second to fourth coin ejection units 110. The engagement members 25*a*, 27*a*, and 29*a* are respectively fixed to the lower side faces (lower surfaces) of the driven gears 25, 27, and 29 in such a way as to protrude downward.

In this embodiment, as shown in FIG. 11, the coupling gear 30 fixed to the upper side face (upper surface) of the driven gear 23 has the structure that gear teeth 30*a* are formed in the upper side face thereof along its circular rim at equal intervals. A gear groove 30*b* is formed between each of the two adjoining gear teeth 30*a*. This means that the gear teeth 30*a* of the coupling gear 30 are formed to protrude upward while the gear teeth of the driven gear 23 are formed to protrude laterally and radially, A shaft hole 30*c* is formed at the center of the coupling gear 30 to be coaxial with the shaft hole of the driven gear 23.

Figure 12A:
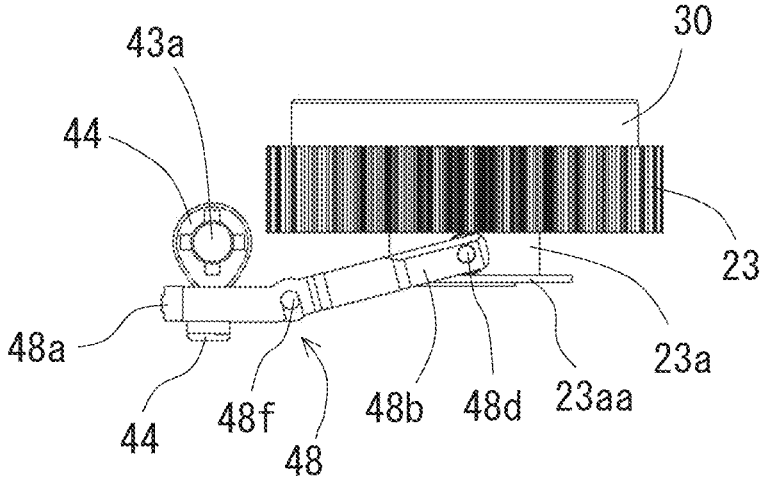
FIG. 12A is a front view showing an example of the engagement structure of the cam follower used for the switching unit of the multi-unit coin ejection apparatus of FIG. 1 with the corresponding driven gear.
Figure 12B:
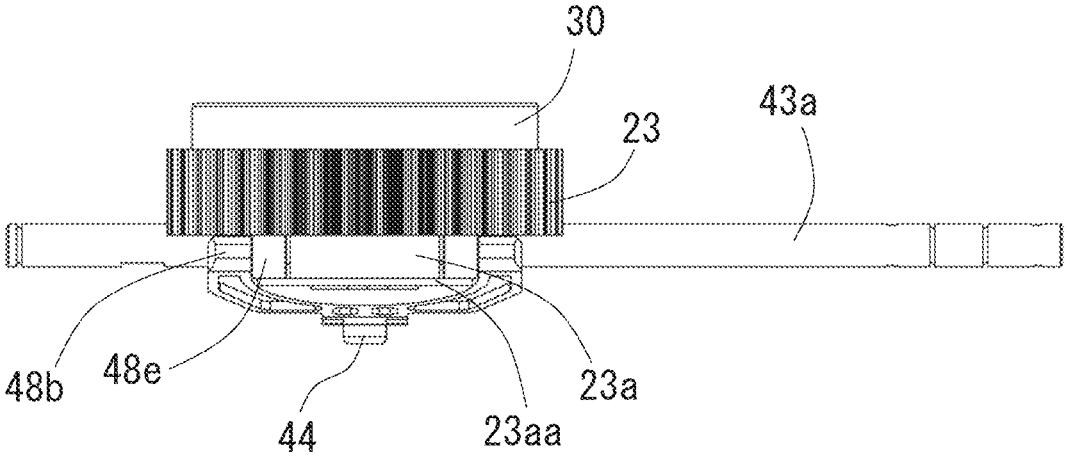
FIG. 12B is a rear view showing the example of the engagement structure of the cam follower used for the switching unit of the multi-unit coin ejection apparatus of FIG. 1 with the corresponding driven gear.

The engagement state of the cam follower 48 and the corresponding engagement member 23*a* is shown in FIGS. 12A and 12B, The cam follower 48 is rockable around the support shaft 48*f* which is fit in the shaft hole 48*c*. Due to the rocking motion of the cam follower 48, the coupling gear 30 (one of the second coupling gears) and the corresponding coupling gear 114 (one of the first coupling gears) can be switched between the connection state and the non-connection state. In FIG. 12A, the protruding part of the cam 44 (i.e., the part of the cam 44 that protrudes most from the cam shaft 43) lowers slightly the cam receiving part 48*a* and at the same time, the branching part 48*b* is slightly raised due to the lowering of the cam receiving part 48*a*, resulting in a slight rising operation of the driven gear 23 and the coupling gear 30. In this state, the coupling gear 30 is engaged or meshed with the corresponding coupling gear 114, which means that the coupling gear 30 is in the connection state. On the other hand, when the cam 44 is rocked and the protruding end thereof is disengaged from the cam receiving part 48*a*, the cam receiving part 48*a* is slightly displaced upward (i.e., returned to the initial position) due to the elastic force of the spring 47 (see FIG. 7, for example) placed just below the cam receiving part 48*a*, as shown in FIG. 12B, resulting in a slight lowering operation of the driven gear 23 and the coupling gear 30 (i.e., returned to the initial position). In this state, the coupling gear 30 is not engaged or meshed with the corresponding coupling gear 114, which means that the coupling gear 30 is in the non-connection state.

The end of the aforementioned spring 47 opposite to the cam receiving part 48*a* is supported by a supporting structure (not shown) provided just below the spring 47 in the chassis 11. For this reason, the elastic force of the spring 47 is always applied to the cam receiving part 48*a* and as a result, the cam receiving part 48*a* is kept at a predetermined upper position and the branching part 48*b* is kept at a predetermined lower position. Accordingly, the coupling gear 30 is located at the aforementioned lower position, i.e., the "non-connection position", except for the time when the branching part 48*b* is pressed downward by the protruding part of the cam 44. When the branching part 48*b* is pressed downward by the protruding part of the cam 44, the coupling gear 30 is moved to the aforementioned upper position, i.e., the "connection position". When the downward pressing action by the protruding part of the cam 44 is lost, the coupling gear 30 is automatically returned to the "non-connection position". In this way, the coupling gear 30 can be switched between the "connection position" and the "non-connection position" by way of the cam follower 48 due to a simple rocking operation of the cam 44.

Figure 13A:
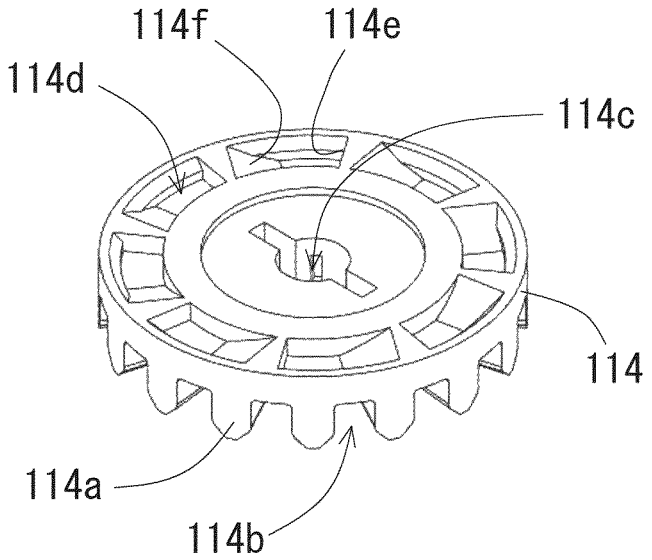
FIG. 13A is a perspective view showing an example of the structure of the coupling gear used for the switching unit of the multi-unit coin ejection apparatus of FIG. 1, which is seen obliquely downward from an upper position.
Figure 13B:
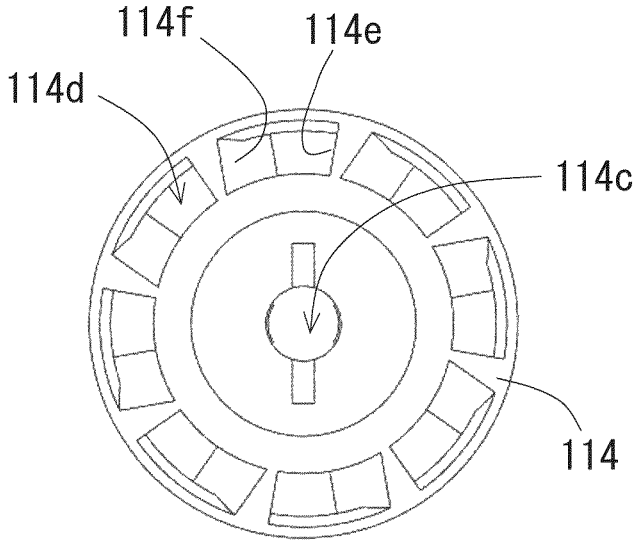
FIG. 13B is a plan view showing the example of the structure of the coupling gear used for the switching unit of the multi-unit coin ejection apparatus of FIG. 1.

An example of the structure of the coupling gear 114 corresponding to the coupling gear 30 is shown in FIGS. 13A and 13B. In this structure example, gear teeth 114*a* are formed in the lower side face thereof along its circular rim at equal intervals. A gear groove 114*b* is formed between each of the two adjoining gear teeth 114*a*. This means that the gear teeth 114*a* of the coupling gear 114 are formed to protrude downward, A shaft hole 114*c* is formed at the center of the coupling gear 114 to be coaxial with the shaft hole of the corresponding coupling gear 30 at the time of connection. The gear teeth 114*a* and the gear grooves 114*b* of the coupling gear 114 can be engaged with the gear grooves 30*b* and the gear teeth 30*a* of the corresponding coupling gear 30, respectively. When the gear teeth 114*a* and the gear grooves 114*b* of the coupling gear 114 are respectively engaged with the gear grooves 30*b* and the gear teeth 30*a* of the corresponding coupling gear 30, i.e., these two gears 114 and 30 are in the connection state, the driving force of the coupling gear 30 is transmitted to the corresponding coupling gear 114 and as a result, the disk 112 of the coin ejection unit 110 connected to the said coupling gear 114 is drivingly rotated, thereby ejecting a coin or coins of the corresponding denomination from the said unit 110.

In the structure example of FIGS. 13A and 13B, the coupling gear 114 comprises engagement holes 114*d* formed along its circular rim at equal intervals. Each of the engagement holes 114*d* has two ends 114*e* and 114*f* formed apart from each other along the rim of the coupling gear 114, The end 114*e* has a perpendicular face with respect to the upper surface of the coupling gear 114 and the end 114*f* has an inclined face with respect to the same upper surface, which means that the coupling gear 114 comprises the engagement holes 114*d* each having the perpendicular end 114*e* and the inclined end 114*f*. This is to realize the function of a one-way clutch. Specifically, when the coupling gear 114 is in the non-connection state, there is a possibility that unintended slip of the coupling gear 114 occurs to result in a phenomenon of undesired dispensing of a coin or coins. The function of the one-way clutch is used for preventing such the phenomenon of undesired coin dispensing. For this reason, the engagement holes 114*d* may be omitted if the function of the one-way clutch is unnecessary.

The camshaft 43 (to which the four cams 44 are fixed and which is drivingly rotated by the second motor M2) and the four cam followers 48 (which are displaced by the corresponding cams 44) constitute a coupling gear displacement mechanism 60. The coupling gear displacement mechanism 60 displaces the coupling gears 30, 31 32, and 33 (which correspond to the second coupling gears) between the predetermined "connection position" and the predetermined "non-connection position". At the "connection position", the coupling gears 30, 31 32, and 33 are respectively engaged with the corresponding four coupling gears 114 (which correspond to the first coupling gears), which means that the coupling gears 30, 31 32, and 33 and the corresponding four coupling gears 114 are in their non-connection state. At the "non-connection position", engagement between the coupling gears 30, 31 32, and 33 and the corresponding four coupling gears 114. is released, which means that the coupling gears 30, 31 32, and 33 and the corresponding four coupling gears 114 are in their non-connection state.

The engagement state (the connection state) and the disengagement state (the non-connection state) between the coupling gears 30, 31 32, and 33 and the corresponding four coupling gears 114 are switched by the coupling gear displacement mechanism 60 in such the manner as explained above. To detect the switching situation, in other words, to detect which one of the first to fourth coin ejection units 110 is in the connection state, four detection members 45 and four optical sensors 46 are provided in the switching unit 40. The four detection members 45 and the four optical sensors 46 are respectively provided for the first to fourth coin ejection units 110.

Figure 6:
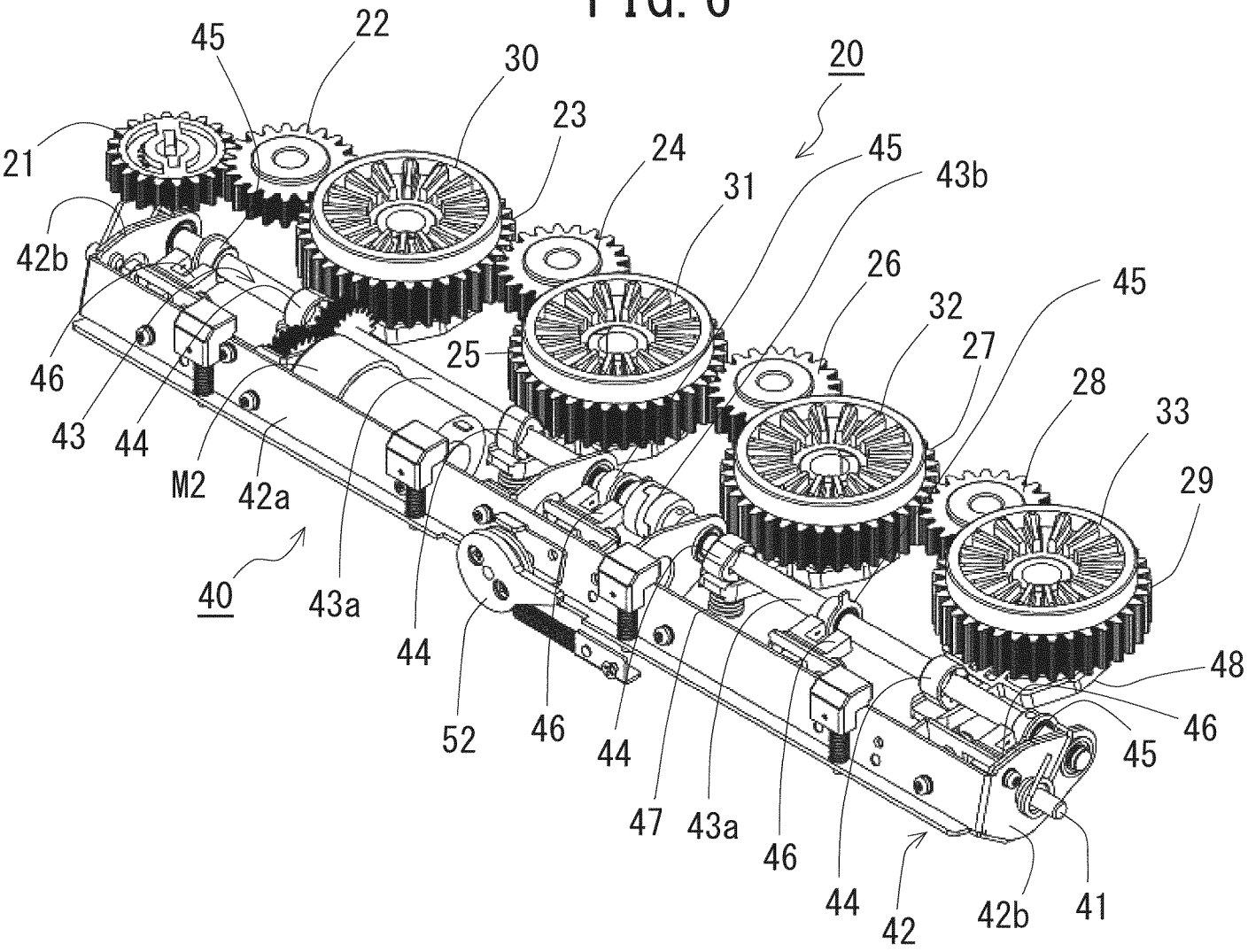
FIG. 6 is a perspective view showing the structure of the driving mechanism and the switching unit of the multi-unit coin ejection apparatus of FIG. 1, which is seen obliquely downward from the upper right front.

As the optical sensors 46, any known infrared sensors or the like may be used; however, any type of sensors other than the optical ones may be used for this purpose. It is sufficient for the sensors that they can detect the connection/disconnection of the first to fourth coin ejection units 110. Here, the four detection members 45, which are the same in shape and size, are fixed to the camshaft 43 at intervals, as shown in FIG. 6, for example.

In this embodiment, each of the four detection members 45 is formed by a circular member having a protrusion which protrudes outwardly from a part of the said member. The camshaft 43 (or the shaft member 43*a*) is inserted into the central hole of the said circular member and fixed at a predetermined position. The optical sensors 46 that correspond to the detection members 45, which are the same in structure and function, are fixed on the inner surface of the frame body 42*a* at the opposite positions to the corresponding detection members 45. Each of the sensors 46 has a gap formed between the light emitting part and the light receiving part thereof. When the protrusion of the detection member 45 is inserted into the gap, the infrared light emitted from the light emitting part toward the light receiving part is blocked by the said protrusion; as a result, the arrival of the protrusion of the said detection member 45 at the corresponding sensor 46 is detected. Due to this detection, it is judged that the coupling gear 30 in question and its corresponding coupling gear 114 are in the engagement state (i.e., the connection state). In the case where this engagement state needs to be maintained, the rotational driving of the second motor M2 is stopped at the same time as the detection of the arrival of the said protrusion at the said sensor 46. In this way, the coupling gear 30 and its corresponding coupling gear 114 are set in the engagement state (i.e., the connection state). As far as this engagement state is held, a coin or coins of a predetermined denomination which is/are stored in the corresponding coin ejection unit 110 is/are dispensed from the same unit 110. When the aforementioned infrared light is not blocked by the said protrusion, it is judged that the coupling gear 30 in question and its corresponding coupling gear 114 are in the non-engagement state (i.e., the non-connection state).

Figure 21:
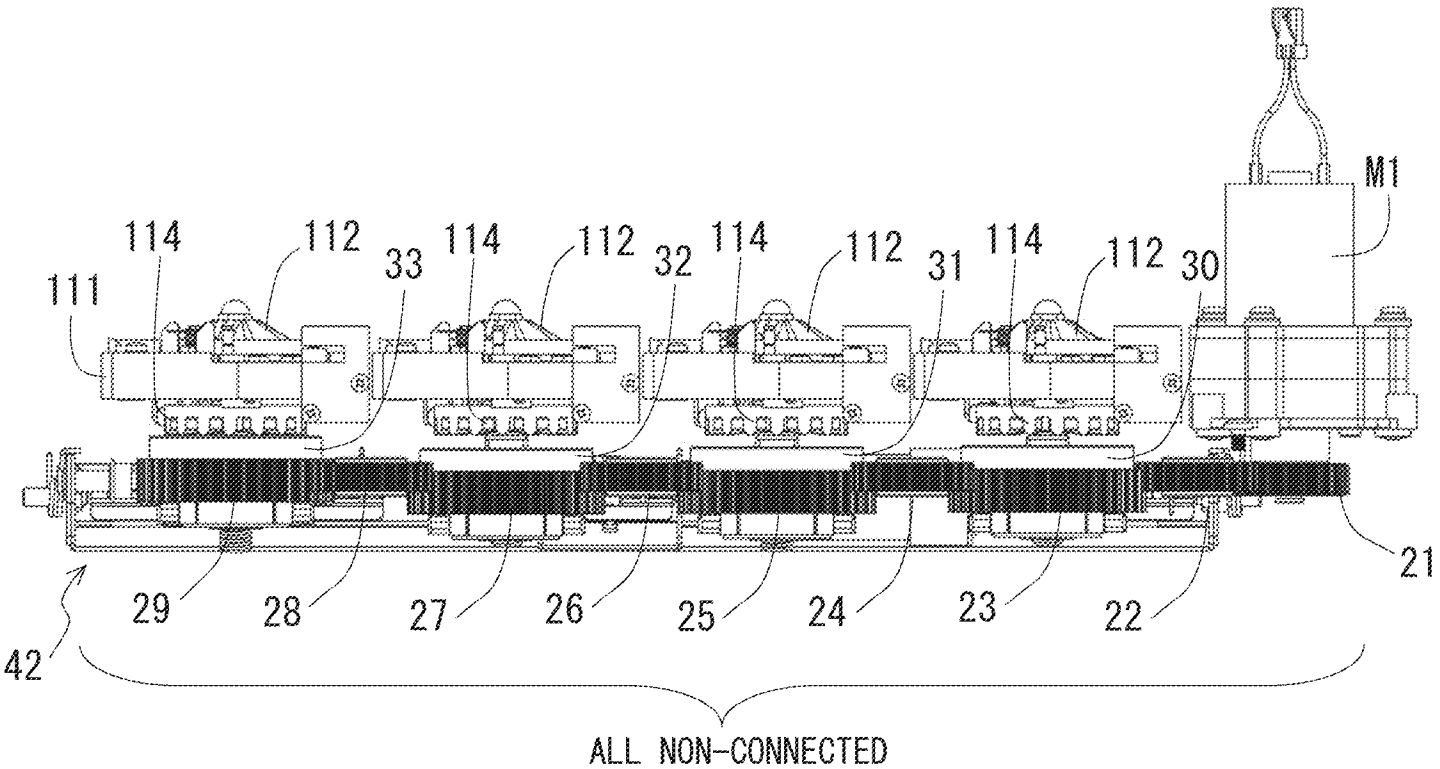
FIG. 21 is an explanatory view showing the connection/non-connect on state of the first to fourth coin ejection units of the multi-unit coin ejection apparatus of FIG. 1, in which all of the first coin ejection units are in the non-connection state (i.e., the multi-unit coin ejection apparatus of FIG. 1 is in the non-operation mode).

In this embodiment, the state where the driving force of the first motor M1 is not transmitted to all of the first to fourth coin ejection units 110 can be set. When the state where the driving force of the first motor M1 is transmitted to any one of the first to fourth coin ejection units 110 (in other words, a coin is ejected from the relevant unit 110) is termed the "operable mode", the state where the driving force of the first motor M1 is not transmitted to all of the first to fourth coin ejection units 110 may be termed the "non-operable mode". In the "non-operable mode", all of the first to fourth coin ejection units 110 are mechanically disconnected from the driving mechanism 20, as shown in FIG. 21 and therefore, there arises an advantage that a desired one of the four coin ejection units 110 can be easily removed from the chassis 11 by sliding the desired unit 110 along the mounting surface 11*a*. It is needless to say that this "non-operable mode" may be omitted.

Figure 14:
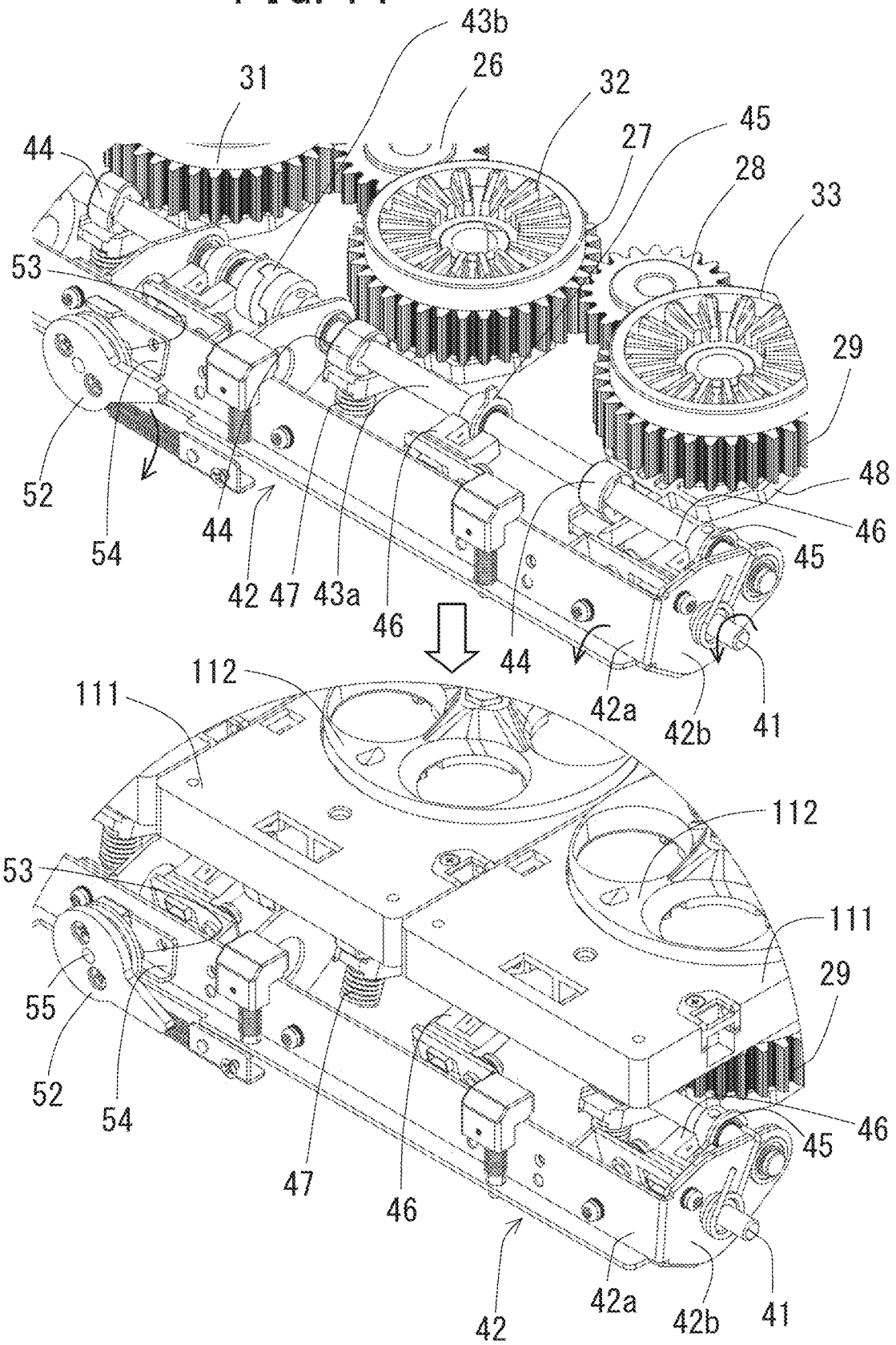
FIG. 14 is an explanatory view showing the switching operation of the multi-unit coin ejection apparatus of FIG. 1 between an operation mode and a non-operation mode by a rocking motion of the switching unit around a support shaft, in which the upper part shows the state in the operation mode and the lower part shows the state in the non-operation mode.

In this embodiment, the shift or transition from the "operable mode" to the "non-operable mode" is realized by operating a lever 52 which is rockably provided on the front side face of the chassis 11, as shown in FIG. 14. Specifically, the lever 52 having an operating member or piece 53 fixed to its back is rockably supported by a rocking shaft 55 fixed to the chassis 1. The operating member or piece 53 of the lever 52 is displaced downward along with the rocking motion of the lever 52. Since a frame rocking member 54 is fixed to the frame body 42*a* on the back side of the lever 52 in such a way as to be overlapped with the lever 52, the frame rocking member 54 is pressed downward along with the rocking motion of the lever 52. In this state, the entire frame 42 is slightly rocked forward around the two supporting shafts 41 which are disposed at the respective ends of the frame 42 and thus, the camshaft 43 which is supported by the frame 42 is slightly displaced upward and the distances between the four cams 44 and their corresponding four cam followers 48 are increased. As a result, as shown in FIG. 7, all of the branching parts 48*a* of the cam followers 48 are moved downward by the elastic forces of the relevant springs 47 disposed just below the corresponding cam receiving parts 48*a*. Due to this lowering motion of the branching parts 48*a*, the four driven gears 23, 25, 27, and 29 and their corresponding coupling gears 30, 31, 32, and 33 are moved downward collectively. In this state, the driving force of the first motor M1 is no longer transmitted to all of the first to fourth coin ejection units 110 regardless of the positions of the protruding parts of the four cams 44. This means that the transition to the "non-operable mode" from the "operable mode" is completed in this way. The return to the "operable mode" can be easily carried out by operating the lever 52 upward to its initial position.

Operation of Multi-Unit Coin Ejection Apparatus 1

Next, the operation of the multi-unit coin ejection apparatus 1 according to the embodiment of the present invention having the aforementioned structure will be explained below with reference to FIG. 15.

FIGS. 15A to 15D show the situation change where the connection state and the non-connection state of the fourth coin ejection unit 110 are switched in order in accordance with the rotational position (the rotational angle) of the corresponding cam 44 included in the switching unit 40 of the multi-unit coin ejection apparatus 1 while the said cam 44 is rotated once. In the following explanation, the situation change that occurs while the camshaft 43 is rotated counterclockwise once, as shown in FIGS. 15A to 15D, will be described.

Figure 15A:
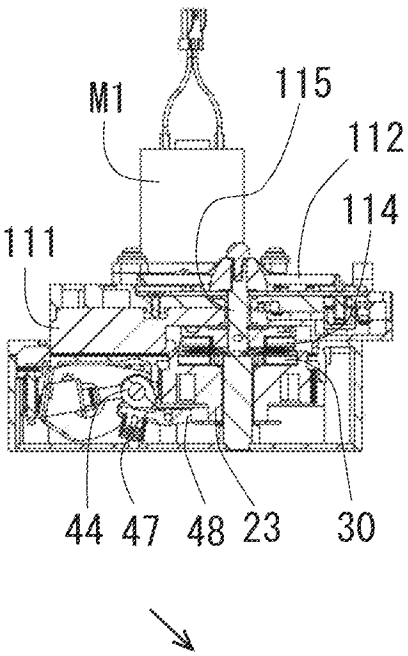
FIG. 15A is a cross-sectional view showing the switching operation of a fourth coin ejection unit of the multi-unit coin ejection apparatus of FIG. 1 between a connection state and a non-connection state according to a rotation position (or a rotation angle) of cams included in the switching unit, in which the fourth coin ejection unit is in the non-connection state.

First, as shown in FIG. 15A, when the protruding part of the cam 44 is in a diagonally downward right direction, the cam receiving part 48*a* of the cam follower 48 corresponding to the said cam 44 is disposed at its upper non-connection position. This is because the said cam receiving part 48*a* is always pressed upward by the elastic force of the corresponding spring 47 which is just below the said cam receiving part 48*a*, In this state, the branching part 48*b* of the said cam follower 48 is disposed at its lower non-connection position, and the coupling gear 114 of the fourth coin ejection unit 110 is apart or disconnected from the corresponding coupling gear 33 of the driving mechanism 20 and therefore, these two coupling gears 114 and 33 are in the non-connection state (the non-connection position). Accordingly, the driving force of the first motor M1 is not transmitted to the coupling gear 114 of the fourth coin ejection unit 110, which means that no coin ejection occurs from the said unit 110.

Figure 15B:
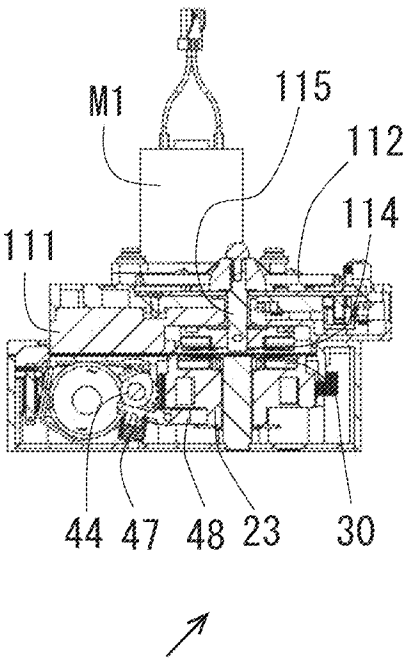
FIG. 15B is a cross-sectional view showing the switching operation of the fourth coin ejection unit of the multi-unit coin ejection apparatus of FIG. 1 between the connection state and the non-connection state, in which the fourth coin ejection unit is in the non-connection state.

Next, when the camshaft 43 is rotated counterclockwise by 90° from the position of FIG. 15A, in other words, the phase of the camshaft 43 is advanced by 90°, the protruding part of the said cam 44 is turned to a diagonally upward right direction, as shown in FIG. 15B. At this time, the cam receiving part 48*a* of the said cam follower 48 is disposed at its upper non-connection position, which is the same as the state of FIG. 15A. In this state also, the branching part 48*b* of the said cam follower 48 is disposed at its lower non-connection position and therefore, the coupling gear 114 of the fourth coin ejection unit 110 is disconnected from the corresponding coupling gear 33 of the driving mechanism 20, which means that these two coupling gears 114 and 33 are in the non-connection state (the non-connection position). For this reason, the driving force of the first motor M1 is not transmitted to the coupling gear 114 of the fourth coin ejection unit 110 and no coin ejection occurs from the said unit 110. This is the same as the state of FIG. 15A.

Figure 15C:
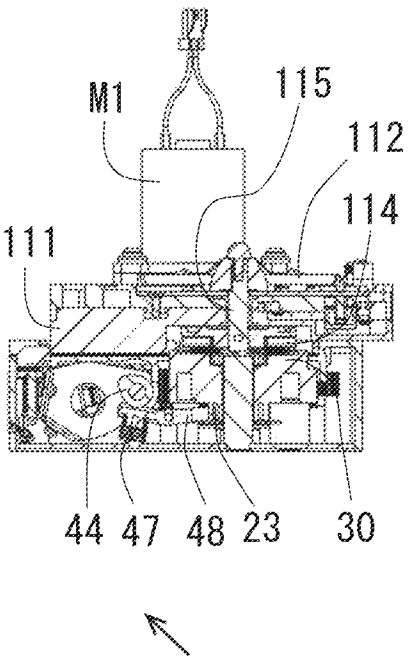
FIG. 15C is a cross-sectional view showing the switching operation of the fourth coin ejection unit of the multi-unit coin ejection apparatus of FIG. 1 between the connection state and the non-connection state, in which the fourth coin ejection unit is in the non-connection state.
Figure 15D:
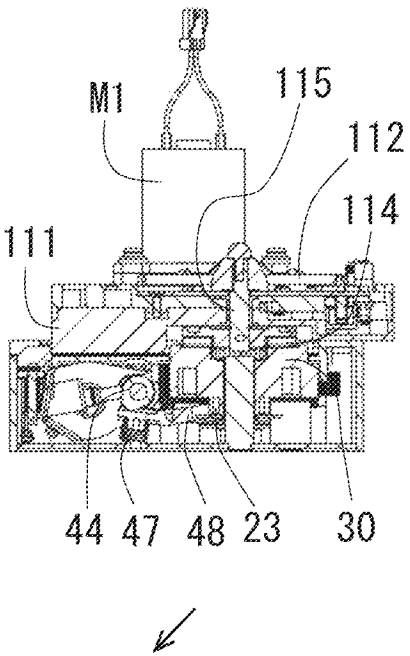
FIG. 15D is a cross-sectional view showing the switching operation of the fourth coin ejection unit of the multi-unit coin ejection apparatus of FIG. 1 between the connection state and the non-connection state, in which the fourth coin ejection unit is in the connection state.

Following this, when the camshaft 43 is further rotated counterclockwise by 90° from the position of FIG. 15B, in other words, the phase of the camshaft 43 is advanced by 180° from the position of FIG. 15A, the protruding part of the said cam 44 is turned to a diagonally upward left direction, as shown in FIG. 15C. At this time also, the cam receiving part 48*a* of the said cam follower 48 is kept at its upper non-connection position, which is the same as the state of FIG. 15A, In this state also, the branching part 48*b* of the said cam follower 48 is kept at its lower non-connection position and therefore, the coupling gear 114 of the fourth coin ejection unit 110 is kept disconnected from the corresponding coupling gear 33 of the driving mechanism 20, which means that these two coupling gears 114 and 33 are kept in the non-connection state (the non-connection position). For this reason, in the state of FIG. 15C also, the driving force of the first motor M1 is not transmitted to the coupling gear 114 of the fourth coin ejection unit 110 and no coin ejection occurs from the said unit 110.

Finally, when the camshaft 43 is further rotated counter-clockwise by 90° from the position of FIG. 15C, in other words, the phase of the camshaft 43 is advanced by 270° from the position of FIG. 15A, the protruding part of the said cam 44 is turned to a diagonally downward left direction, as shown in FIG. 150. At this time, the cam receiving part 48*a* of the said cam follower 48 is moved to its lower connection position, which is different from the states of FIGS. 15A to 15C. This is because the said cam receiving part 48*a* of the said cam follower 48 is pressed downward by the protruding part of the said cam 44 against the elastic force of the corresponding spring 47. Due to this downward motion of the said cam receiving part 48*a*, the branching part 48*b* of the said cam follower 48 is moved to its upper connection position. In this connection position, the coupling gear 114 of the fourth coin ejection unit 110 is engaged or connected to the corresponding coupling gear 33 of the driving mechanism 20, which means that these two coupling gears 114 and 33 are moved to the connection state (the connection position). For this reason, in the state of FIG. 15D, the driving force of the first motor M1 is transmitted to the coupling gear 114 of the fourth coin ejection unit 110 and coin ejection occurs from the said unit 110 in response to a dispensing instruction.

Figure 20B:
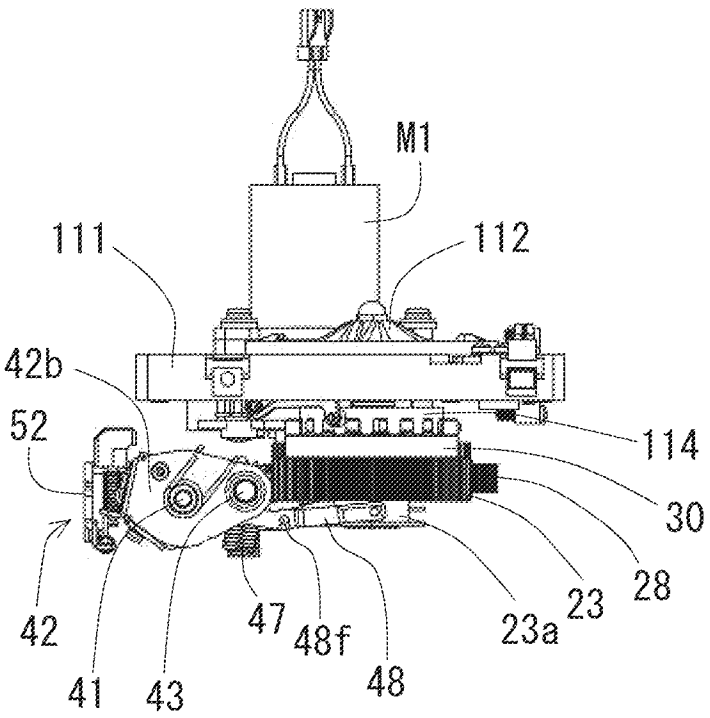
FIG. 20B is an explanatory view showing the relative positions of the coupling gear in the first coin ejection unit and the corresponding coupling gear on the driven gear, in which the relative positions in the non-connection state is shown.
Figure 20A:
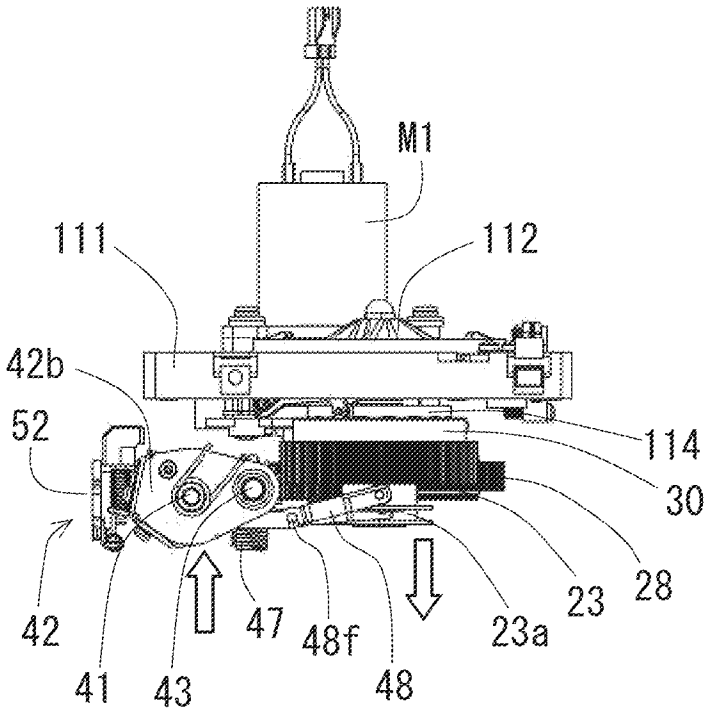
FIG. 20A is an explanatory view showing the relative positions of the coupling gear in the first coin ejection unit and the corresponding coupling gear on the driven gear, in which the relative positions in the connection state is shown.

As explained above, due to the rocking motion of the cam 44 which is caused by the rotation of the camshaft 43, the coupling gear 114 of the fourth coin ejection unit 110 is engaged with the corresponding coupling gear 33 of the driving mechanism 20 (i.e., both of the coupling gears 114 and 33 are moved to the connection position), as shown in FIG. 20A, or disengaged from the corresponding coupling gear 3 of the driving mechanism 20 (i.e., both of the coupling gears 114 and 33 are moved to the non-connection position), as shown in FIG. 20B. In this way, the coin ejection operation from the fourth coin ejection unit 110 can be performed only at the limited time when both of the coupling gears 114 and 33 are in the connection position. This is applicable to the first to third coin ejection units 110 also.

The situation where the engagement (connections) states between the four coupling gears 110 of the first to fourth coin ejection units 110 and the corresponding four coupling gears 30, 31, 32, and 33 are changed by the rotation of the single camshaft 43 is shown in FIGS. 16 to 19.

Figure 16:
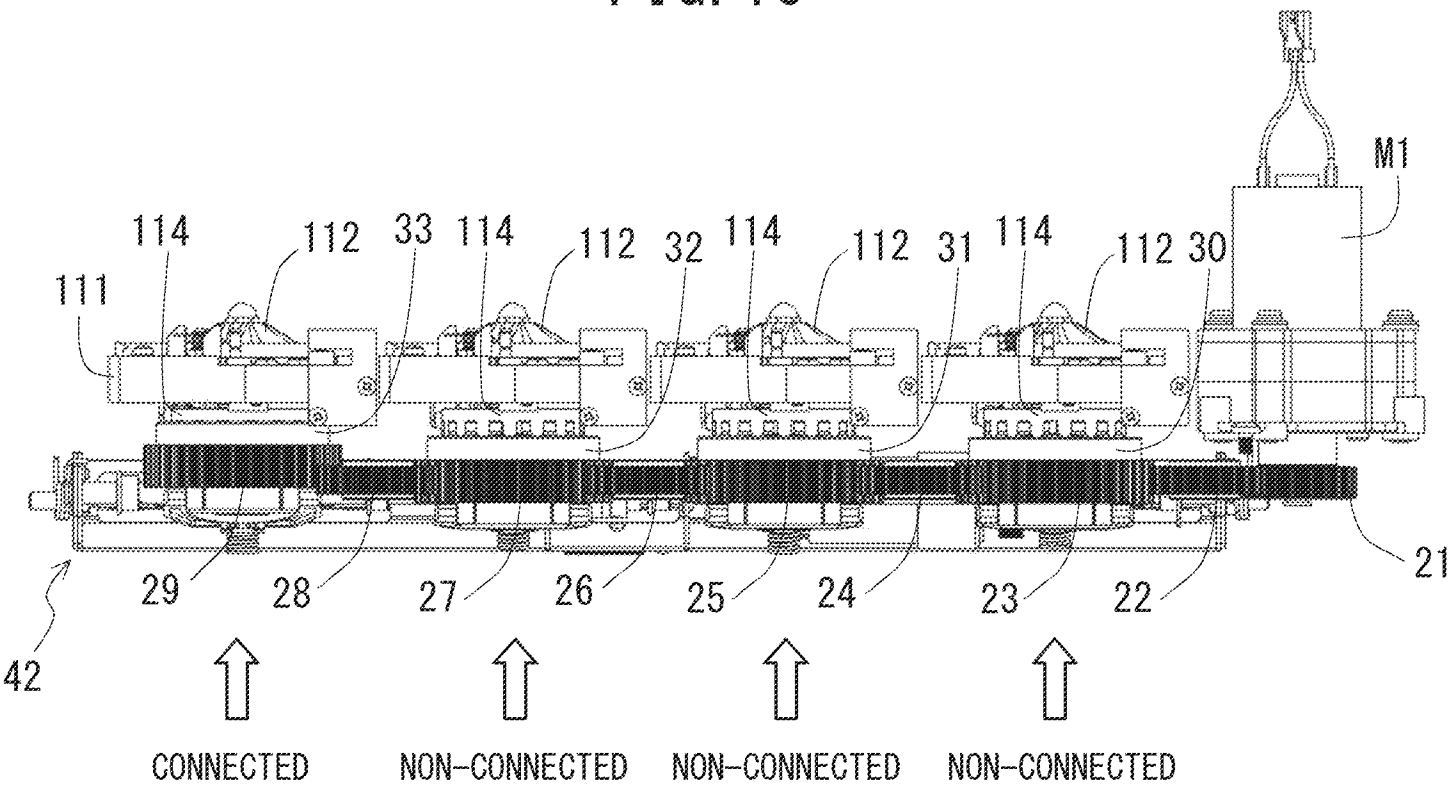
FIG. 16 is an explanatory view showing the connection/non-connection state of the first to fourth coin ejection units of the multi-unit coin ejection apparatus of FIG. 1, in which only the fourth coin ejection unit is in the connection state and the first to third coin ejection units are in the non-connection state.
Figure 17:
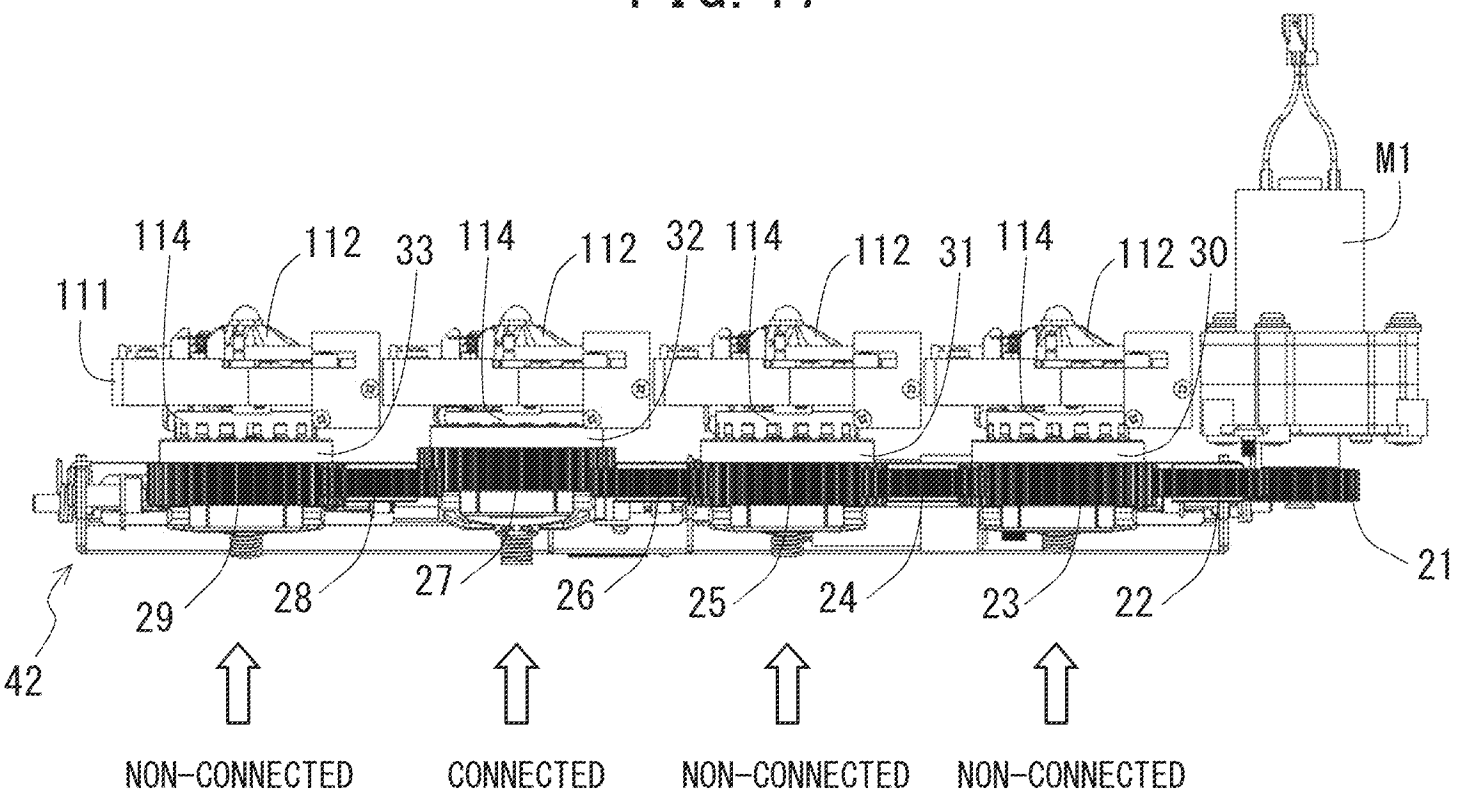
FIG. 17 is an explanatory view showing the connection/non-connection state of the first to fourth coin ejection units of the multi-unit coin ejection apparatus of FIG. 1, in which only the third coin ejection unit is in the connection state and the first, second, and fourth coin ejection units are in the non-connection state.
Figure 18:
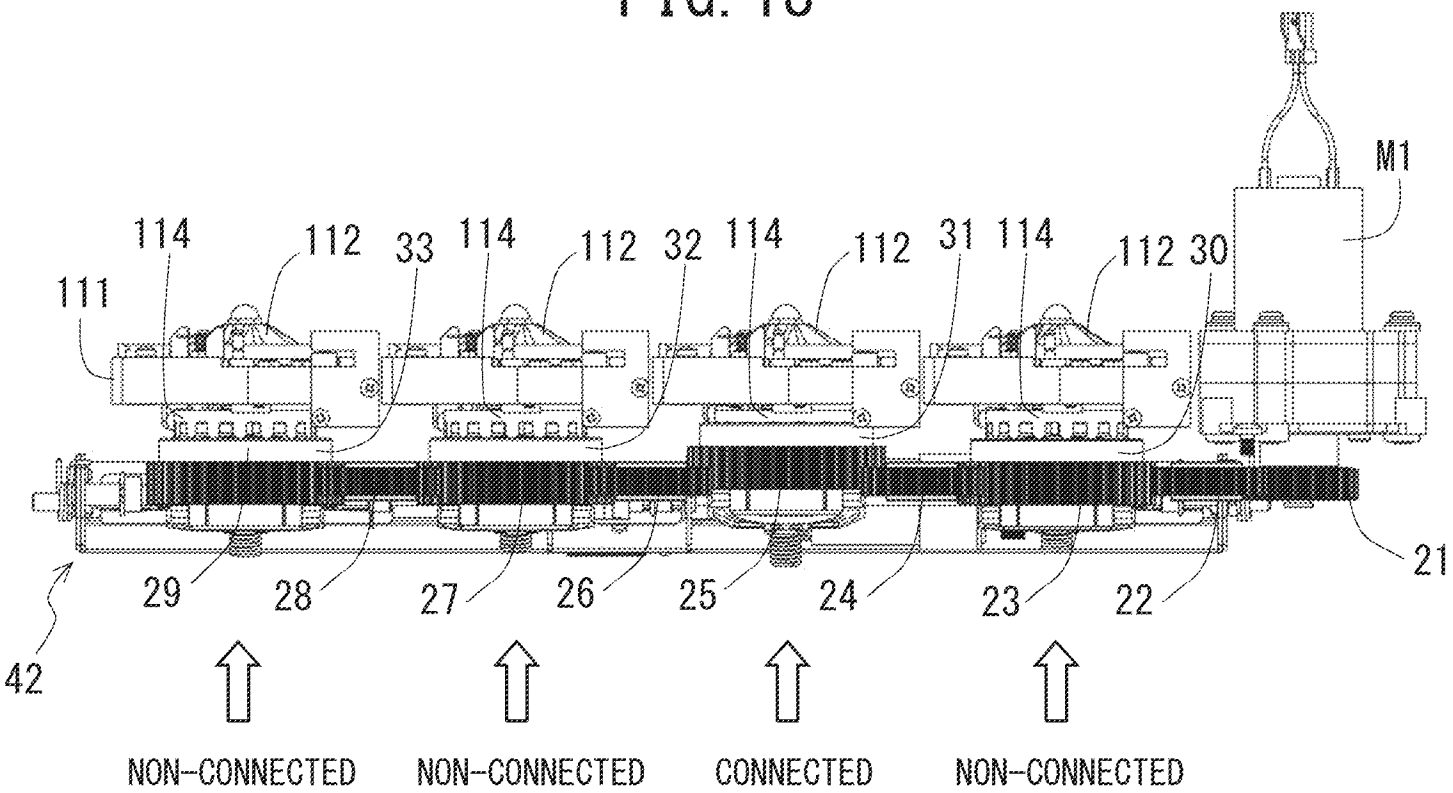
FIG. 18 is an explanatory view showing the connection/non-connection state of the first to fourth coin ejection units of the multi-unit coin ejection apparatus of FIG. 1, in which only the second coin ejection unit is in the connection state and the first, and third to fourth coin ejection units are in the non-connection state.
Figure 19:
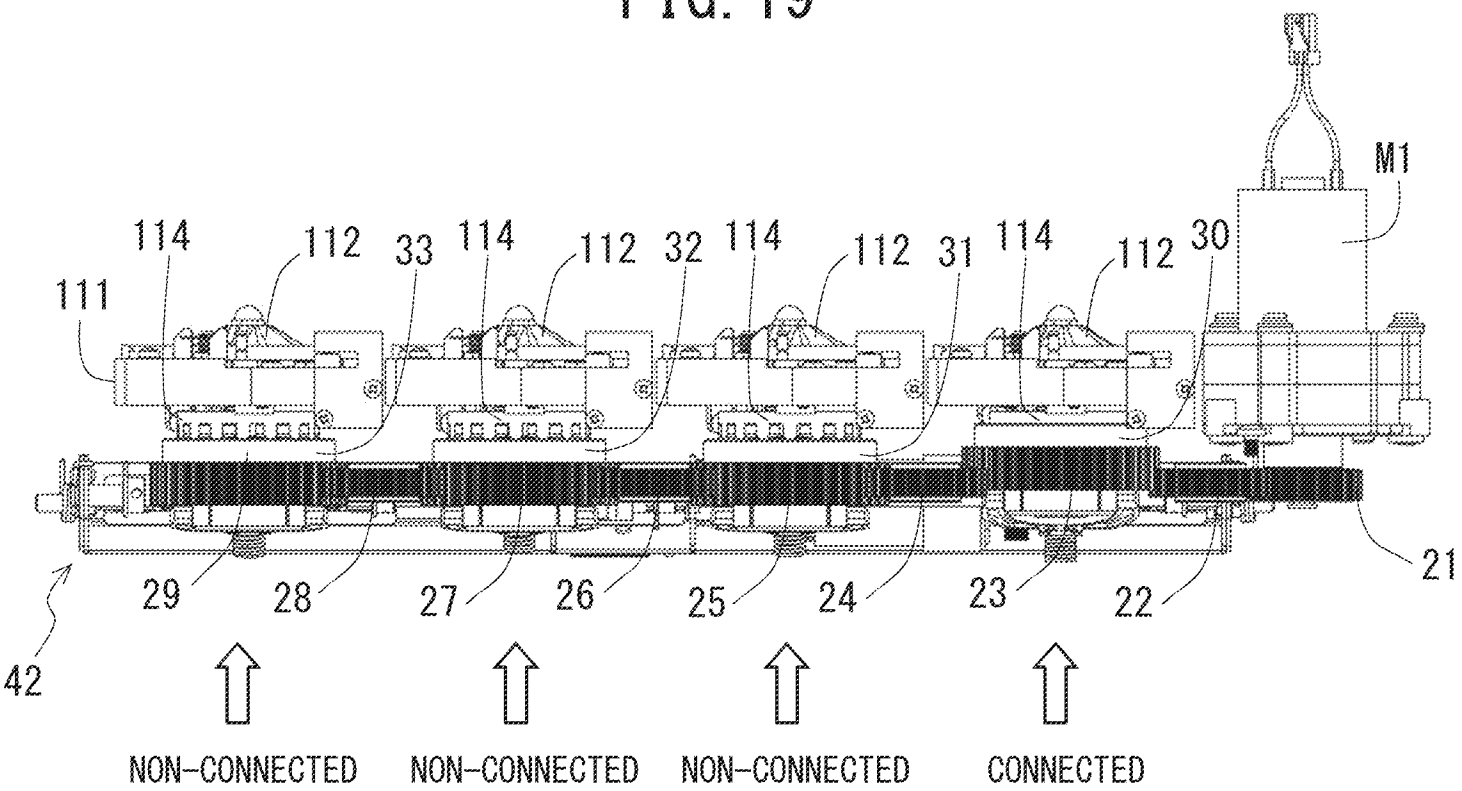
FIG. 19 is an explanatory view showing the connection/non-connection state of the first to fourth coin ejection units of the multi-unit coin ejection apparatus of FIG. 1, in which only the first coin ejection unit is in the connection state and the second to fourth coin ejection units are in the non-connection state.

In the state of FIG. 16, only the coupling gear 33 of the driving mechanism 20 corresponding to the fourth coin ejection unit 110 is displaced upward and only the fourth coin ejection unit 110 is in the connection state while the first to third coin ejection units 110 are in the non-connection state. In the state of FIG. 17, only the coupling gear 33 of the driving mechanism 20 corresponding to the third coin ejection unit 110 is displaced upward and only the third coin ejection unit 110 is in the connection state while the first, second, and fourth coin ejection units 110 are in the non-connection state. In the state of FIG. 18, only the coupling gear 33 of the driving mechanism 20 corresponding to the second coin ejection unit 110 is displaced upward and only the second coin ejection unit 110 is in the connection state while the first, third, and fourth coin ejection units 110 are in the non-connection state. In the state of FIG. 19, only the coupling gear 33 of the driving mechanism 20 corresponding to the first coin ejection unit 110 is displaced upward and only the first coin ejection unit 110 is in the connection state while the second to fourth coin ejection units 110 are in the non-connection state. In this way, any one of the first to fourth coin ejection units 110 can be selectively connected and driven by simply changing the phase (the rotational position) of the four cams 44.

Concretely speaking, for example, in the case where a dispensing instruction for dispensing the amount of 630 YEN as the change, the control device (not shown) of the multi-unit coin ejection apparatus 1 controls or operates the switching unit 40 in accordance with the dispensing instruction in the following way:

Specifically, first, the first coin ejection unit 110 for ejecting coins of 500 YEN is selected as the transmission destination of the driving force of the first motor M1 and driven by the first motor M1, thereby ejecting one coin of 500 YEN. Next, the second coin ejection unit 110 for ejecting coins of 100 YEN is selected as the transmission destination of the said driving force and driven, thereby ejecting one coin of 100 YEN. Furthermore, the third coin ejection unit 110 for ejecting coins of 10 YEN is selected as the transmission destination of the said driving force and driven, thereby ejecting three coins of 10 YEN successively. In this way, the aforementioned dispensing instruction for the amount of 630 YEN can be executed.

As explained above in detail, with the multi-unit coin ejection apparatus 1 according to the embodiment of the present invention, the first to fourth coin ejection units 110 are structured in such a way that any one of the first to fourth coin ejection units 110 is selectively driven by switching the transmission destination of the driving force of the commonly used first motor M1 using the switching unit 40 in response to an instruction. The switching unit 40 comprises (i) the four coupling gears 114 (which correspond to the first coupling gears) respectively provided for the first to fourth coin ejection units 110, (ii) the four coupling gears 30, 31, 32, and 33 (which correspond to the second coupling gears) provided for the driving mechanism 20 so as to be engageable with the corresponding four coupling gears 114, and (iii) the coupling gear displacement mechanism 60 that displaces the coupling gears 30, 31, 32, and 33 between the predetermined connection position and the predetermined non-connection position. Here, the coupling gear displacement mechanism 60 comprises the camshaft 43 which is rotationally driven by the second motor M2 and which has the four cams 44 assigned respectively to the first to fourth coin ejection units 110; and the cam followers 48 which are respectively engaged with the four coupling gears 114 and which are respectively displaced by the corresponding cams 44. The four coupling gears 30, 31, 32, and 33 are displaced between the connection position and the non-connection position according to the displacements of the corresponding cam followers 48 due to the rotations of the corresponding cams 44. The coupling gear displacement mechanism 60 having such the structure as above is operated in such a way that a designated one of the first to fourth coin ejection units 110 is disposed at the connection position, thereby transmitting the driving force of the first motor M1 to (the rotating disk 112 of) the designated one of the coin ejection units 110 in accordance with an instruction.

Accordingly, by using the coupling gear displacement mechanism 60, a designated one of the first to fourth coin ejection units 110 where coins of a desired denomination are stored in the corresponding coin storing container 120 can be selectively disposed at the connection position while the remaining three coin ejection units 110 are disposed at the non-connection position. Thus, it is possible to transmit the driving force of the first motor M1 to the designated coin ejection unit 110 alone, thereby ejecting one or more coins of the desired denomination from the said unit 110. In other words, any amount of coins can be dispensed as desired by repeating the coin ejection operation necessary times while appropriately switching the transmission destination of the first motor M1 among the first to fourth coin ejection units 110 according to the necessity. This means that it is unnecessary to control the permission and prevention of coin ejection in each of the first to fourth coin ejection units 110 individually even in the structure where these four coin ejection units 110 are driven by the first motor M1 alone.

As a result, with the multi-unit coin ejection apparatus 1 according to the embodiment of the present invention, it is unnecessary to provide a mechanism for selectively ejecting one or more coins of a necessary denomination in each of the coin ejection units in response to a dispensing instruction, such as the shutter provided in each of the coin ejection units of the multi-unit coin ejection apparatus disclosed in the aforementioned Publication No. 6182787, in spite of using the structure where the first to fourth coin ejection units 110 are configured to be driven by the first motor M1 alone. In other words, there is an advantage that coins of desired denominations can be selectively ejected from the first to fourth coin ejection units 110 as desired without using such the selective coin ejection mechanism as disclosed in the Publication No. 6182787.

Moreover, the switching unit 40 can be formed by the four coupling gears 114 (the first coupling gears) respectively provided for the first to fourth coin ejection units 110, the four coupling gears 30, 31, 32, and 33 (the second coupling gears) provided for the driving mechanism 20 so as to be engageable with the corresponding coupling gears 114, and the coupling gear displacement mechanism 60 that displaces the coupling gears 30, 31, 32, and 33 between the predetermined connection position and the predetermined non-connection position; in which the engagement and disengagement between the four coupling gears 114 and the corresponding four coupling gears 30, 31, 32, and 33 can be carried out by simply operating the coupling gear displacement mechanism 60. Accordingly, a simple structure which can be produced at a low cost, such as the rotationally driven camshaft 43 which is driven by the second motor M2 and to which the four cams 44 are fixed at different phases, can be used for the coupling gear displacement mechanism 60. Furthermore, as described above, it is unnecessary to provide a mechanism that controls the permission and prevention of coin ejection in each of the first to fourth coin ejection units 110 individually.

Accordingly, the structure of each of the first to fourth coin ejection units 110 can be simplified and these coin ejection units 110 can be produced at a low cost. Moreover, these coin ejection units 110 are unlikely to malfunction and are able to have desired durability easily.

Furthermore, the multi-unit coin ejection apparatus 1 according to the embodiment of the present invention has the following additional advantages in addition to the aforementioned advantages.

Specifically, with the multi-unit coin ejection apparatus 1, each of the four coupling gears 114 (the first coupling gears) respectively provided for the first to fourth coin ejection units 110 is formed by a gear which is fixed to the rotational shaft 115 of the corresponding unit 110 and which has the gear teeth 114*a* and the gear grooves 114*b* on its side face. Each of the four coupling gears 30, 31, 32, and 33 (the second coupling gears) provided for the driving mechanism 20 is formed by a gear which is fixed to the corresponding driven gear 23, 25, 27, or 29 of the driving mechanism 20 and which has the gear grooves 30*b* and the gear teeth 30*a* on its side face that are engageable with the gear teeth 114*a* and the gear grooves 114*b* of the corresponding coupling gear 114. Accordingly, there is an additional advantage that the structure for performing the engagement and disengagement between the four coupling gears 114 and the corresponding four coupling gears 30, 31, 32, and 33 can be realized easily.

Moreover, with the multi-unit coin ejection apparatus 1, e coupling gear displacement mechanism 60 comprises the camshaft 43 which is rotationally driven by the second motor M2 and which has the four cams 44 assigned to the first to fourth coin ejection units 110, and the four cam followers 48 which are respectively engaged with the four coupling gears 114 for the first to fourth coin ejection units 110 and which are displaced by the corresponding cams 44. The four coupling gears 30, 31, 32, and 33 are displaced between the connection position and the non-connection position according to displacements of the corresponding cam followers 48 due to rotations of the corresponding cams 44, Accordingly, there is an additional advantage that the coupling gear displacement mechanism 60 can be realized using a very simple structure.

Moreover, with the multi-unit coin ejection apparatus 1, the four sensors 46 that detect respectively the rotational positions (the rotational angles) of the four cams 44 fixed to the camshaft 43 are provided and the four detection members 45 are fixed to the same camshaft 43 at the corresponding positions to the fixed positions of the cams 44, in which the sensors 46 detect optically the corresponding detection members 45. Accordingly, there is an additional advantage that the rotational positions (the rotational angles) of the four cams 44 can be detected constantly with a simple structure and the coin ejection operation of the first to fourth coin ejection units 110 can be controlled precisely.

Moreover, with the multi-unit coin ejection apparatus 1, the "non-operable mode" where the driving force of the first motor M1 is not transmitted to all of the first to fourth coin ejection units 110 is provided in addition to the "operable mode" where the driving force of the first motor M1 is transmitted to any one of the first to fourth coin ejection units 110. Accordingly, there is an additional advantage that a desired one of the first to fourth coin ejection units 110 can be easily removed from the chassis 11 or exchanged for another unit by sliding the desired unit 110 along the mounting surface 11*a*.

Moreover, with the multi-unit coin ejection apparatus 1, the coupling gear displacement mechanism 60 is entirely supported by the two support shafts 41 so as to be rockable around the same shafts 41, and the operable mode and the non-operable mode are switchable by simply rocking the whole coupling gear displacement mechanism 60 around the rocking shaft 55 through the manipulation of the lever 52 which is rockably supported by the chassis 1. Accordingly, there is an additional advantage that the switching operation between the operable mode and the non-operable mode can be carried out easily.

Moreover, with the multi-unit coin ejection apparatus 1, in the "non-operable mode", all of the first to fourth coin ejection units 110 are detachable from the mounting surface 11*a* or the chassis 11 by moving a desired one of the first to fourth coin ejection units 110 along the mounting surface 11*a*. Accordingly, there is an additional advantage that removal or exchange of these four coin ejection units 110 can be carried out easily according to the necessity.

Modifications

The aforementioned embodiment is an exemplary embodied example of the present invention. Thus, it is needless to say that the present invention is not limited to this embodiment and any other modification is applicable to the embodiment without departing the spirit of the invention.

For example, in the aforementioned embodiment, the coupling gears 30, 31, 32, and 33 shown in FIGS. 11A to 110, each of which has the gear teeth 30*a* and the gear grooves 30*b* on its side face, are used for the driving mechanism 20, and the four coupling gears 114 shown in FIGS. 13A to 13B, each of which has the gear teeth 114*a* and the gear grooves 114*b* on its side face, are used for the four coin ejection units 110. However, the present invention is not limited to this. It is needless to say that any coupling gear having a different structure from the structures shown in FIGS. 11 and 13 may be used for this purpose if it enables the transmission of the driving force of the first motor M1 to a desired one of the first to fourth coin ejection units 110 from the driving mechanism 20.

In addition, in the aforementioned embodiment, as the coupling gear displacement mechanism 60, the camshaft 43 which is rotationally driven by the second motor M2 and which has the four cams 44 assigned to the first to fourth coin ejection units 110, and the four cam followers 48 which are displaced by the corresponding cams 44 are used. However, the present invention is not limited to this. It is needless to say that any other combination than that of the camshaft 43 and the cam followers 48 may be used for this purpose if it enables the desired displacement between the coupling gears 30, 31, 32, and 33 and the corresponding coupling gears 114.

Furthermore, there is no limit to the structure of the coin ejection units 11 for the multi-unit coin ejection apparatus 1. Any type of coin ejection unit having any structure can be used for this purpose if it enables the coin ejection of desired denominations using a rotatable disk 112 around the rotational shaft 115.

INDUSTRIAL APPLICABILITY

The multi-unit coin ejection apparatus according to the present invention is applicable not only to coins as currency but also to coin equivalents such as token and medals. Moreover, the multi-unit coin ejection apparatus according to the present invention is applicable not only to any coin depositing/dispensing apparatus but also to any coin processing apparatus that necessitates selective ejection of coins of desired denominations.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A multi-unit coin ejection apparatus, comprising:

a base having a mounting surface;

coin ejection units mounted on the mounting surface;

a first motor commonly used for the coin ejection units;

a driving mechanism, provided below the mounting surface, that is configured to drive the coin ejection units by transmitting a driving force of the first motor using gears; and a switching unit, provided below the mounting surface, that is configured to switch a destination of the driving force of the first motor, thereby selectively driving the coin ejection units;

wherein the switching unit comprises (i) first coupling gears which are respectively provided for the coin ejection units, (ii) second coupling gears which are engageable with the corresponding first coupling gears and which are provided for the driving mechanism, and (iii) a coupling gear displacement mechanism that is configured to displace the second coupling gears between a predetermined connection position and a predetermined non-connection position, wherein the coupling gear displacement mechanism comprises:

a camshaft rotationally driven by a second motor, wherein the camshaft has cams which are assigned to respective coin ejection units, and cam followers which are respectively engaged with the second coupling gears and which are displaceable by corresponding cams;

wherein the second coupling gears are displaced between the connection position and the non-connection position according to displacements of the cam followers due to rotations of the corresponding cams;

the coupling gear displacement mechanism is operated in response to an instruction in such a way that a designated one of the second coupling gears is disposed at the connection position and that a remainder of the second coupling gears is/are disposed at the non-connection position in accordance with the instruction; and when a designated one of the second coupling gears is disposed at the connection position by the coupling gear displacement mechanism in response to an instruction, the driving force of the first motor is selectively transmitted to a corresponding one of the coin ejection units to the designated one of the second coupling gears.

2. The apparatus according to claim 1, wherein each of the first coupling gears is formed by a gear which is fixed to a rotation shaft of a corresponding one of the coin ejection units and which has teeth and grooves formed on one side face thereof; and each of the second coupling gears is formed by a gear which is fixed to a corresponding linking gear of the driving mechanism and which has teeth and grooves formed on one side face thereof to be engageable respectively with the grooves and the teeth of a corresponding one of the first coupling gears.

3. The apparatus according to claim 1, further comprising sensors that detect a rotational position of the camshaft; and the coupling gear displacement mechanism judges which one of the second coupling gears is disposed at the connection position based on the detected rotational position of the camshaft by the sensors.

4. The apparatus according to claim 1, wherein detection members are fixed to the camshaft in a one-by-one correspondence to the cams;

sensors that detect respectively rotational positions of the detection members are provided at corresponding positions to the detection members; and the coupling gear displacement mechanism judges which one of the second coupling gears is disposed at the connection position based on the detected rotational positions of the detection member by the sensors.

5. The apparatus according to claim 1, wherein a non-operable mode where the driving force of the first motor is not transmitted to all of the coin ejection units is provided in addition to an operable mode where the driving force of the first motor is transmitted to any one of the coin ejection units; and the non-operable mode and the operable mode are configured to be switchable according to the necessity.

6. The apparatus according to claim 1, wherein the coupling gear displacement mechanism is configured to rotate from one side to another about a shaft, which is supported by the base;

an operable mode where the driving force of the first motor is transmitted to any one of the coin ejection units and a non-operable mode where a driving force of the first motor is not transmitted to all of the coin ejection units are provided; and the operable mode and the non-operable mode are configured to be switchable by a rocking motion of the coupling gear displacement mechanism around the shaft.

7. The apparatus according to 1, claim wherein a non-operable mode where the driving force of the first motor is not transmitted to all of the coin ejection units is provided in addition to an operable mode where the driving force of the first motor is transmitted to any one of the coin ejection units;

all of the coin ejection units are configured to be detachable from the base by a motion along the mounting surface; and the coin ejection units can be selectively detached from the base by sliding a desired one or ones of the coin ejection units along the mounting surface in the non-operable mode; that detect a rotational position of the camshaft; and the coupling gear displacement mechanism judges which one of the second coupling gears is disposed at the connection position based on the detected rotational position of the camshaft by the sensors.

* * * * *